US008529008B2

(12) United States Patent
Usuda et al.

(10) Patent No.: US 8,529,008 B2
(45) Date of Patent: Sep. 10, 2013

(54) FLUID EJECTING APPARATUS AND FLUID EJECTING METHOD

(75) Inventors: Hidenori Usuda, Matsumoto (JP); Yoshihiko Matsuzawa, Matsumoto (JP); Yuji Hatanaka, Shiojiri (JP); Bunji Ishimoto, Matsumoto (JP); Tsuyoshi Sano, Shiojiri (JP); Mitsuaki Yoshizawa, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 231 days.

(21) Appl. No.: 12/966,876

(22) Filed: Dec. 13, 2010

(65) Prior Publication Data

US 2011/0141173 A1 Jun. 16, 2011

(30) Foreign Application Priority Data

Dec. 15, 2009 (JP) ..... 2009-284397
Apr. 2, 2010 (JP) ..... 2010-086402

(51) Int. Cl.
*B41J 29/38* (2006.01)

(52) U.S. Cl.
USPC ..... 347/14; 347/9; 347/19

(58) Field of Classification Search
USPC ..... 347/5, 9, 14, 15, 19
See application file for complete search history.

(56) References Cited

U.S. PATENT DOCUMENTS

| | | | | |
|---|---|---|---|---|
| 7,407,277 | B2 | 8/2008 | Yoneyama | |
| 7,798,602 | B2 | 9/2010 | Kobayashi et al. | |
| 2010/0066780 | A1 * | 3/2010 | Akatsuka | 347/14 |

FOREIGN PATENT DOCUMENTS

JP 2002-038063 A 2/2002

* cited by examiner

*Primary Examiner* — Lam S Nguyen
(74) *Attorney, Agent, or Firm* — Kilpatrick Townsend & Stockton LLP

(57) ABSTRACT

An apparatus includes: a first nozzles for ejecting a first fluid are lined up in a predetermined direction; a second nozzles for ejecting a second fluid are lined up in the predetermined direction; and a control unit performs an ejecting operation of ejecting fluid from the nozzles, wherein the control unit forms an image on a medium in one of a first mode of forming a main image with the first fluid and a second mode of forming the main image and a background image with the second fluid to be overlapped, forms the main image using a certain nozzle group in the first nozzles when the main image is formed in the first mode, and forms the main image using the same nozzle group as the certain nozzle group when the main image is formed in the second mode.

10 Claims, 15 Drawing Sheets

FIG. 7

IMAGE QUALITY LEVEL 3 (QUICK MODE)

IMAGE QUALITY LEVEL 1 (SHARP MODE)

IMAGE QUALITY LEVEL 2 (NORMAL MODE)

| WHITE USE MODE | | PRINT PATTERN 1 | PRINT PATTERN 2 | PRINT PATTERN 3 | PRINT PATTERN 4 | PRINT PATTERN 5 |
|---|---|---|---|---|---|---|
| IMAGE QUALITY EVALUATION | FRONT PRINT MODE | △ | △ | ○ | ○ | ◎ |
| | REAR PRINT MODE | △ | ○ | ◎ | ◎ | ◎ |
| PRINT SPEED | | 1 | 2 | 3 | 5 | 4 |

< PRINT PATTERN 3 >

< PRINT PATTERN 4 >

FIG. 13

IMAGE QUALITY LEVEL 3 (QUICK MODE)

IMAGE QUALITY LEVEL 1 (SHARP MODE)

IMAGE QUALITY LEVEL 2 (NORMAL MODE)

| | | |
|---|---|---|
| FRONT PRINT MODE (COLOR/WHITE USE) | PRINT PATTERN 5 | Co: #1 – #7<br>(W: #8 – #14)<br>TRANSPORT AMOUNT: 5D/4 |
| REAR PRINT MODE (COLOR/WHITE USE) | PRINT PATTERN 3 | Co: #8 – #14<br>(W: #1 – #7)<br>TRANSPORT AMOUNT: 4D/3 |

FLUID EJECTING APPARATUS AND FLUID EJECTING METHOD

Priority is claimed under 35 U.S.C. §119 to Japanese Application No. 2009-284397 filed on Dec. 15, 2009, and No2010-086402 filed on Apr. 2, 2010, which is hereby incorporated by reference in its entirety.

BACKGROUND

1. Technical Field

The present invention relates to a fluid ejecting apparatus and a fluid ejecting method.

2. Related Art

As a fluid ejecting apparatus, there is an ink jet printer (hereinafter, referred to as a printer) having a nozzle row in which nozzles for ejecting ink (fluid) onto a medium are arrayed in a predetermined direction. As the printer, a printer which repeatedly performs an operation of ejecting ink from the nozzles while moving the nozzle row in a movement direction intersecting the predetermined direction and an operation of transporting the medium in the predetermined direction is known.

In addition, a printing apparatus for performing printing using white ink as well as color inks including cyan, magenta, and yellow colors is known (for example, refer to JP-A-2002-38063). In such a printer, for example, a background image printed with the white ink and a color image are overlapped to be printed, and thus a color image with good color developing property can be printed without being influenced by a background color of the medium. Accordingly, there is a printer which performs printing by selecting one from a "white use mode" of printing a background image and a color image (main image) to be overlapped and a "color mode" of printing only a color image.

In a case where nozzles used for printing a color image in the white use mode are different from those in the color mode, due to a difference between the characteristics of the nozzles or a difference between optimal print patterns, there is a concern that image quality of the color image (main image) in one of the modes may be degraded compared to that in the other mode.

SUMMARY

An advantage of some aspects of the invention is an enhancement in the quality of a main image regardless of mode.

According to an aspect of the invention, a fluid ejecting apparatus includes: a first nozzle row in which nozzles for ejecting a first fluid are lined up in a predetermined direction; a second nozzle row in which nozzles for ejecting a second fluid are lined up in the predetermined direction; and a control unit which repeatedly performs an ejecting operation of ejecting fluid from the nozzles while relatively moving relative positions of the first and second nozzle rows and a medium in a movement direction intersecting the predetermined direction and a moving operation of relatively moving the relative positions of the first and second nozzle rows and the medium in one direction of the predetermined direction, wherein the control unit forms an image on the medium in one of a first mode of forming a main image with the first fluid on the medium and a second mode of forming the main image and a background image with the second fluid to be overlapped on the medium, forms the main image using a certain nozzle group in the first nozzle row when the main image is formed in the first mode, and forms the main image using the same nozzle group as the certain nozzle group when the main image is formed in the second mode.

Further features of the invention will become apparent from the following description of the specification and the accompanying drawings.

BRIEF DESCRIPTION OF THE DRAWINGS

The invention will be described with reference to the accompanying drawings, wherein like numbers reference like elements.

FIG. 7 is a diagram illustrating an evaluation result of print patterns 1 to 5.

FIG. 13 shows a print pattern table stored in a memory.

DESCRIPTION OF EXEMPLARY EMBODIMENTS

Summary of Disclosure

Figure 1:
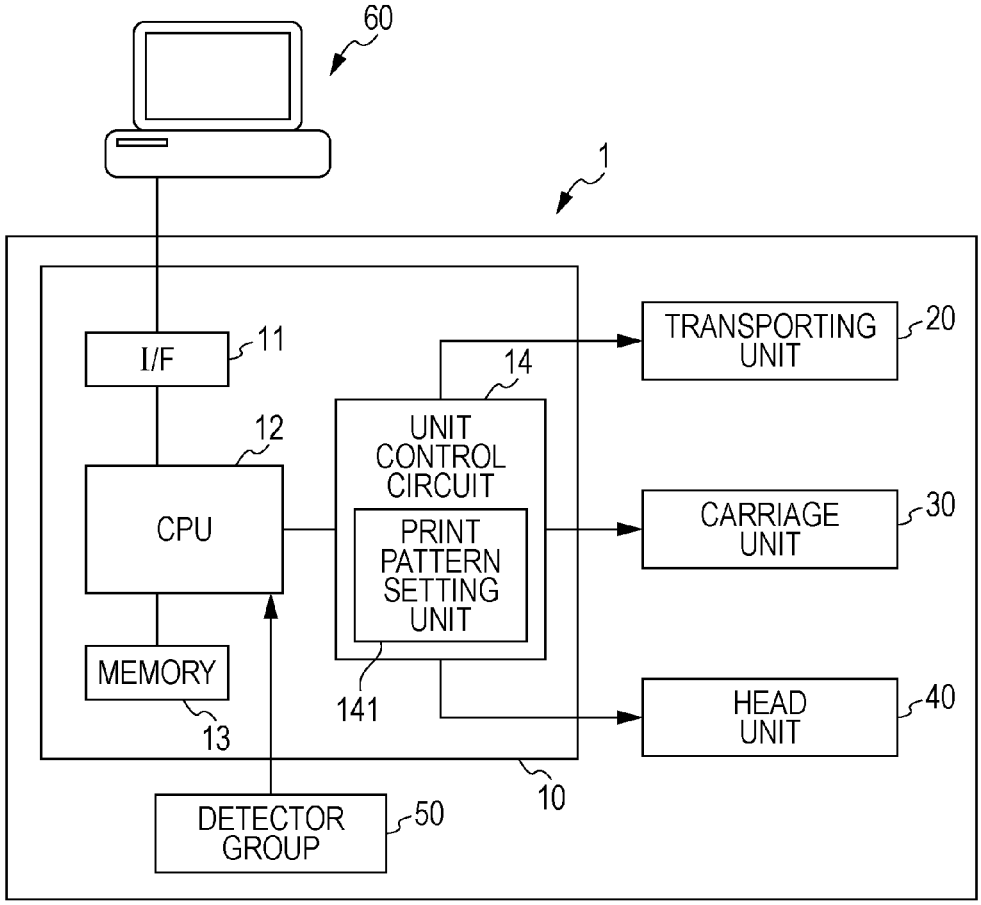
FIG. 1 is a block diagram of the entire configuration of a printer.

At least the following features will become apparent from the description of the specification and the accompanying drawings.

That is, there is provided a fluid ejecting apparatus including: a first nozzle row in which nozzles for ejecting a first fluid are lined up in a predetermined direction; a second nozzle row in which nozzles for ejecting a second fluid are lined up in the predetermined direction; and a control unit which repeatedly performs an ejecting operation of ejecting fluid from the nozzles while relatively moving relative positions of the first and second nozzle rows and a medium in a movement direction intersecting the predetermined direction and a moving operation of relatively moving the relative positions of the first and second nozzle rows and the medium in one direction of the predetermined direction. The control unit forms an image on the medium in one of a first mode of forming a main image with the first fluid on the medium and a second mode of forming the main image and a background image with the second fluid to be overlapped on the medium, forms the main image using a certain nozzle group in the first nozzle row when the main image is formed in the first mode, and forms the main image using the same nozzle group as the certain nozzle group when the main image is formed in the second mode.

According to the fluid ejecting apparatus, the quality of the main image can be enhanced regardless of the mode, and the dot formation methods and medium transport control methods can be shared by the first and second modes, thereby simplifying the manufacturing process of the fluid ejecting apparatus.

In the fluid ejecting apparatus, the control unit forms an image on the medium in one of a first method of forming an image viewed from an image formation side and a second method of forming an image viewed from the reverse side to the image formation side on the medium. When the image is formed in the first method, in the second mode, the control unit forms the main image by a nozzle group of a part of the first nozzle row positioned on one direction side of the predetermined direction and forms the background image by a nozzle group of a part of the second nozzle row positioned closer to the other direction side of the predetermined direction than the nozzle group used for forming the main image, and in the first mode, the control unit forms the main image using the same nozzle group as the nozzle group in the first nozzle row for forming the main image in the second mode and in the first method. When the image is formed in the second method, in the second mode, the control unit forms the main image by the nozzle group of the part of the first nozzle row positioned on the other direction side of the predetermined direction and forms the background image by the nozzle group of the part of the second nozzle row positioned closer to the one direction side of the predetermined direction than the nozzle group for forming the main image, and in the first mode, the control unit forms the main image using the same nozzle group as the nozzle group in the first nozzle row for forming the main image in the second mode and in the second method.

According to the fluid ejecting apparatus, the dot formation methods, the medium transport control methods, and the like can be shared by each method (the first method and the second method) of the first mode and each method of the second mode, thereby simplifying the manufacturing process of the fluid ejecting apparatus.

In the fluid ejecting apparatus, a dot formation method of forming the main image in the first mode and in the first method is the same as a dot formation method of forming the main image in the second mode and in the first method, and a dot formation method of forming the main image in the first mode and in the second method is the same as a dot formation method of forming the main image in the second mode and in the second method.

According to the fluid ejecting apparatus, the manufacturing process of the fluid ejecting apparatus can be simplified.

In the fluid ejecting apparatus, the control unit forms an image on the medium in the first mode when the first method is selected, or forms an image on the medium in the first method when the first mode is selected.

According to the fluid ejecting apparatus, modes or methods of forming an image can be easily determined.

In the fluid ejecting apparatus, the control unit forms an image on the medium in the first mode and in the first method when the medium is an opaque medium.

According to the fluid ejecting apparatus, modes or methods of forming an image can be easily determined.

In the fluid ejecting apparatus, a dot formation method used when an image at a predetermined image quality level is formed on the medium in the first method and a dot formation method used when an image at the predetermined image quality level is formed on the medium in the second method are different from each other.

According to the fluid ejecting apparatus, an image formation time can be reduced according to methods while maintaining image quality.

In the fluid ejecting apparatus, a dot formation method of forming the main image in the first mode is the same as a dot formation method of forming the main image in the second mode.

According to the fluid ejecting apparatus, the manufacturing process of the fluid ejecting apparatus can be simplified.

In the fluid ejecting apparatus, the background image is formed using the nozzles in the first nozzle row disposed at the same position in the predetermined direction as the nozzle group in the second nozzle row for forming the background image.

According to the fluid ejecting apparatus, a background image with a desired color can be imaged.

In addition, there is provided a fluid ejecting method of a fluid ejecting apparatus which repeatedly performs an ejecting operation, while relatively moving relative positions of a first nozzle row in which nozzles for ejecting first fluid are lined up in a predetermined direction, a second nozzle row in which nozzles for ejecting second fluid are lined up in the predetermined direction, and a medium in a movement direction intersecting the predetermined direction, of ejecting fluid from the nozzles, and a moving operation of relatively moving the relative positions of the first and second nozzle rows and the medium in one direction of the predetermined direction, the fluid ejecting method including: setting one of a first mode of forming a main image with the first fluid on the medium and a second mode of forming the main image and a background image with the second fluid to be overlapped on the medium, and forming an image on the medium in the set mode; forming the main image using a certain nozzle group in the first nozzle row when the main image is formed in the first mode; and forming the main image using the same nozzle group as the certain nozzle group when the main image is formed in the second mode.

According to the fluid ejecting method, dot formation methods and medium transport control methods can be shared by the first and second modes, thereby simplifying the manufacturing process of the fluid ejecting apparatus.

Printing System

Hereinafter, an ink jet printer (hereinafter, a printer) is used as a fluid ejecting apparatus, and a printing system in which the printer is connected to a computer is exemplified for the description of exemplary embodiments.

Figure 2:
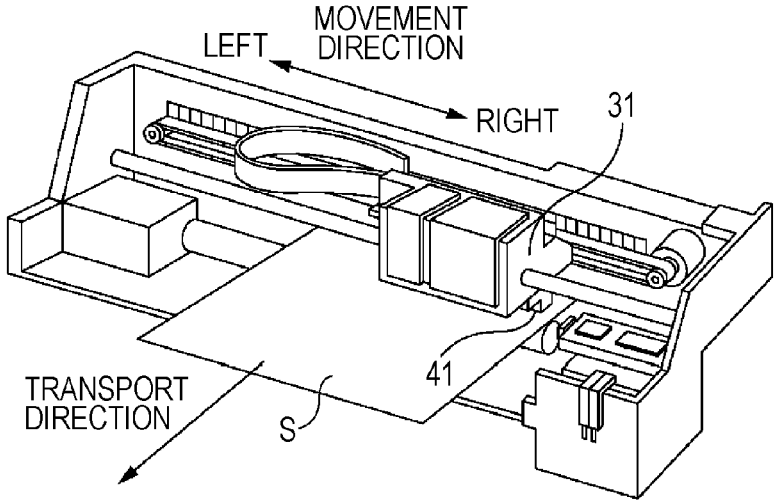
FIG. 2 is a perspective view of the printer.

FIG. 1 is a block diagram of the entire configuration of a printer 1. FIG. 2 is a perspective view of the printer 1. A computer 60 is connected to the printer 1 to communicate therewith and outputs print data to be used for printing an image by the printer 1 to the printer 1. In addition, installed in the computer 60 is a program (printer driver) for converting image data output from an application program into the print data. The printer driver may be recorded on a recording medium (a recording medium that the computer can read out) such as a CD-ROM or downloaded by the computer via the Internet.

A controller 10 is a control unit for controlling the printer 1. An interface unit 11 is used for receiving and transmitting data between the computer 60 and the printer 1. The CPU 12 is an arithmetic processing unit for controlling the entire printer 1. A memory 13 is used for providing an area for storing the programs of the CPU 12 and a work area. The CPU 12 controls each unit by a unit control circuit 14. In addition, a detector group 50 monitors the status in the printer 1, and the controller 10 controls each unit on the basis of the detection result.

A transporting unit 20 sends a medium S to a position where printing can be performed and transports the medium S by a predetermined transport amount in a transport direction (predetermined direction) during the printing.

A carriage unit 30 is used for moving a head 41 in a movement direction intersecting the transport direction and includes a carriage 31.

The head unit 40 is used for ejecting ink onto the medium S and includes the head 41. The head 41 is moved in the movement direction by the carriage 31. Provided on a lower surface of the head 41 is a plurality of nozzles which are ink ejecting portions, and each nozzle is provided with an ink chamber (not shown) containing ink.

Figure 3:
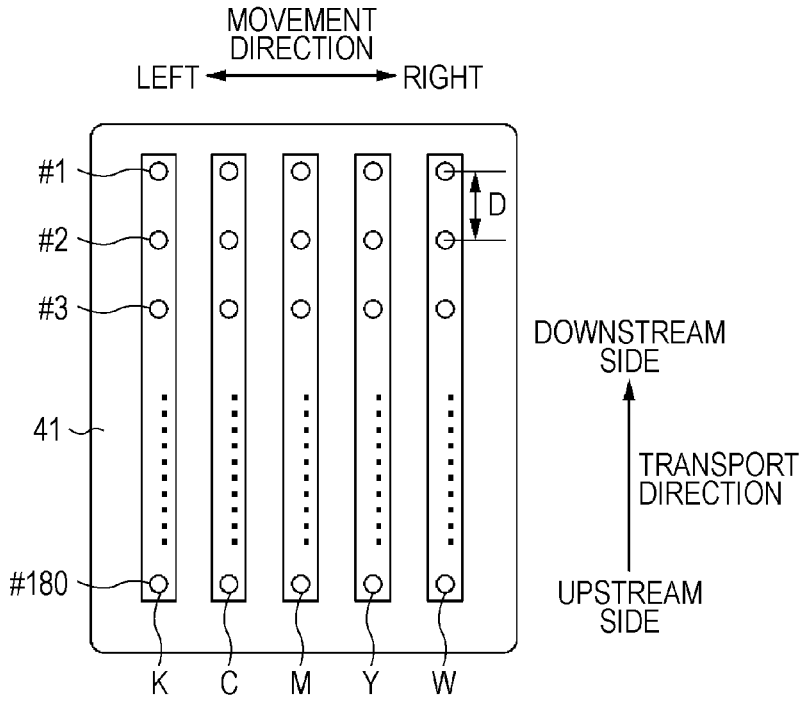
FIG. 3 is a diagram illustrating an array of nozzles provided on a lower surface of a head.

FIG. 3 is a diagram illustrating an array of the nozzles provided on the lower surface of the head 41. In addition, the diagram illustrates the nozzles virtually viewed from an upper surface of the head 41. Formed on the lower surface of the head 41 are 5 nozzle rows each in which 180 nozzles are arrayed in the transport direction at a predetermined interval (a nozzle pitch D). As illustrated in FIG. 3, a black nozzle row K for ejecting black ink, a cyan nozzle row C for ejecting cyan ink, a magenta nozzle row M for ejecting magenta ink, a yellow nozzle row Y for ejecting yellow ink, and a white nozzle W for ejecting white ink are arrayed along the movement direction. Moreover, the 180 nozzles of each nozzle row are assigned with numbers in ascending order from a downstream side of the transport direction (#1 to #180).

In the printer 1, a dot formation process for forming dots on the medium by intermittently ejecting ink droplets from the head 41 which moves along the movement direction and a transport process (corresponding to a movement operation) for transporting the medium in the transport direction with respect to the head 41 are repeatedly performed. Accordingly, dots may be formed by the subsequent dot formation process at a different position on the medium from a position at which dots are formed by the preceding dot formation process, thereby printing a 2D image on the medium. In addition, an operation in which the head 41 moves once in the movement direction while ejecting ink droplets (corresponding to one dot formation process and the ejecting operation) is called a "pass".

Print Mode

Figure 4:
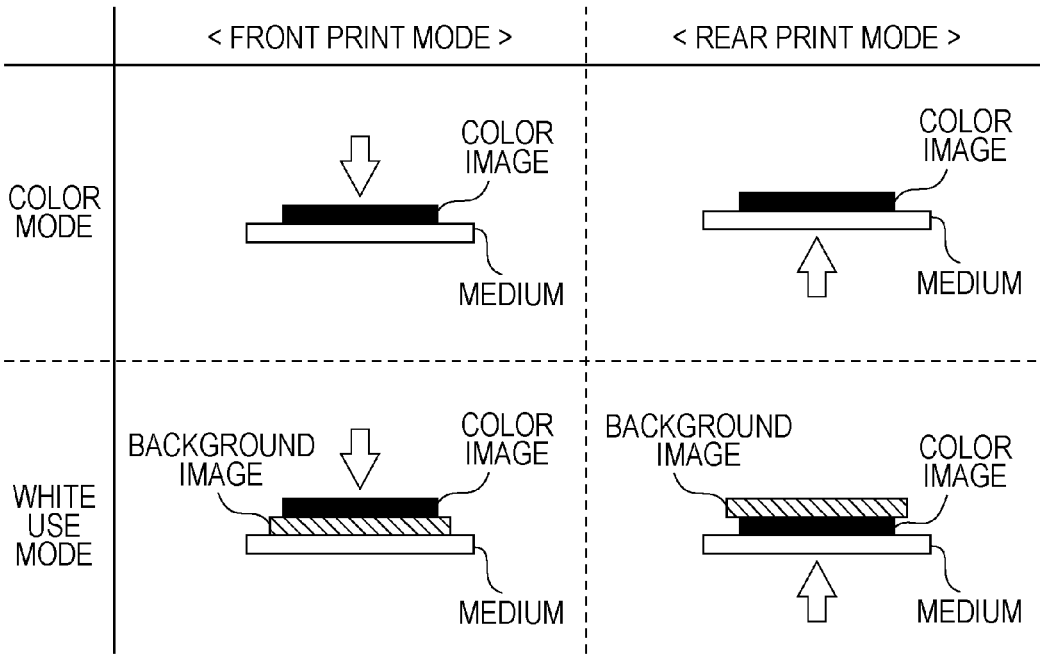
FIG. 4 is a diagram for explaining print modes of the printer.

FIG. 4 is a diagram for explaining print modes of the printer 1 according to this embodiment. The printer 1 forms an image on the medium in one of certain modes including a "color mode (corresponding to a first mode)" for printing only a color image (including a monochrome image) to be printed with 4-color ink (YMCK) on the medium, and a "white use mode (corresponding to a second mode)" for printing a background image with white ink and a color image to be overlapped on the medium. By providing the white background image as a background of the color image (corresponding to a main image) in the white use mode, an image with good color developing property can be printed, particularly when the medium is not white. In addition, when the medium is transparent, by printing the color image and the background image to be overlapped, it is possible to prevent the opposite side of the printed matter from becoming transparent.

Moreover, the printer 1 forms an image on the medium in one of certain modes including a "front print mode (a first method)" for printing a color image to be seen from a printed surface side and a "rear print mode (a second method)" for printing the color image to be seen from the medium side (the opposite side to the image formation side). That is, the printer 1 includes, as illustrated in FIG. 4, four print modes including a front print and color mode, a rear print and color mode, a front print and white use mode, and a rear print and white use mode.

In order to print only the color image on the medium in the color mode, the color image is directly printed on the medium in any of the front print mode and the rear print mode. In the white use mode, in order to print the color image and the background image to be overlapped, in the front print mode the background image is printed on a predetermined area of the medium in advance, and the color image is printed on the background image. On the contrary, in the rear print mode, the color image is printed on the predetermined area of the medium in advance, and the background image is printed on the color image.

Figure 5:
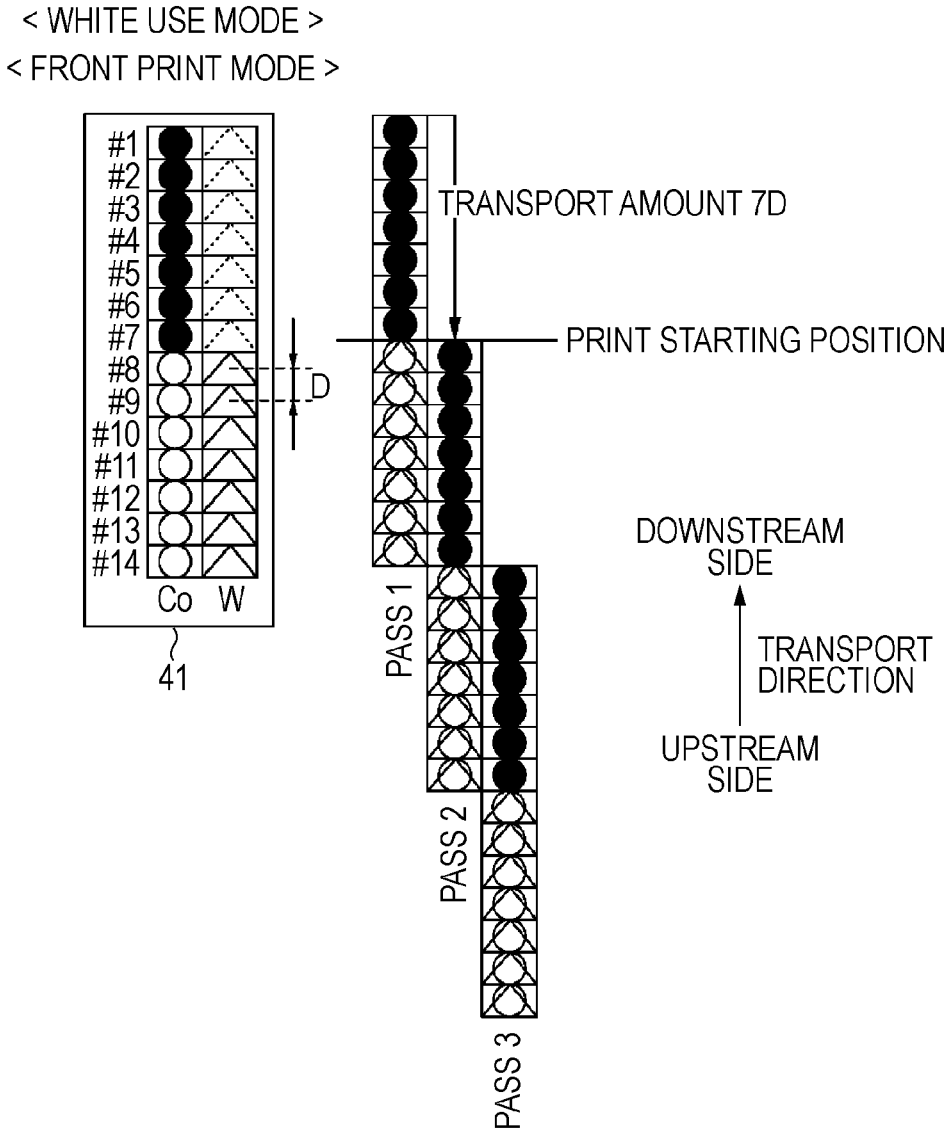
FIG. 5 is a diagram illustrating a printed example in a front print and white use mode.
Figure 6:
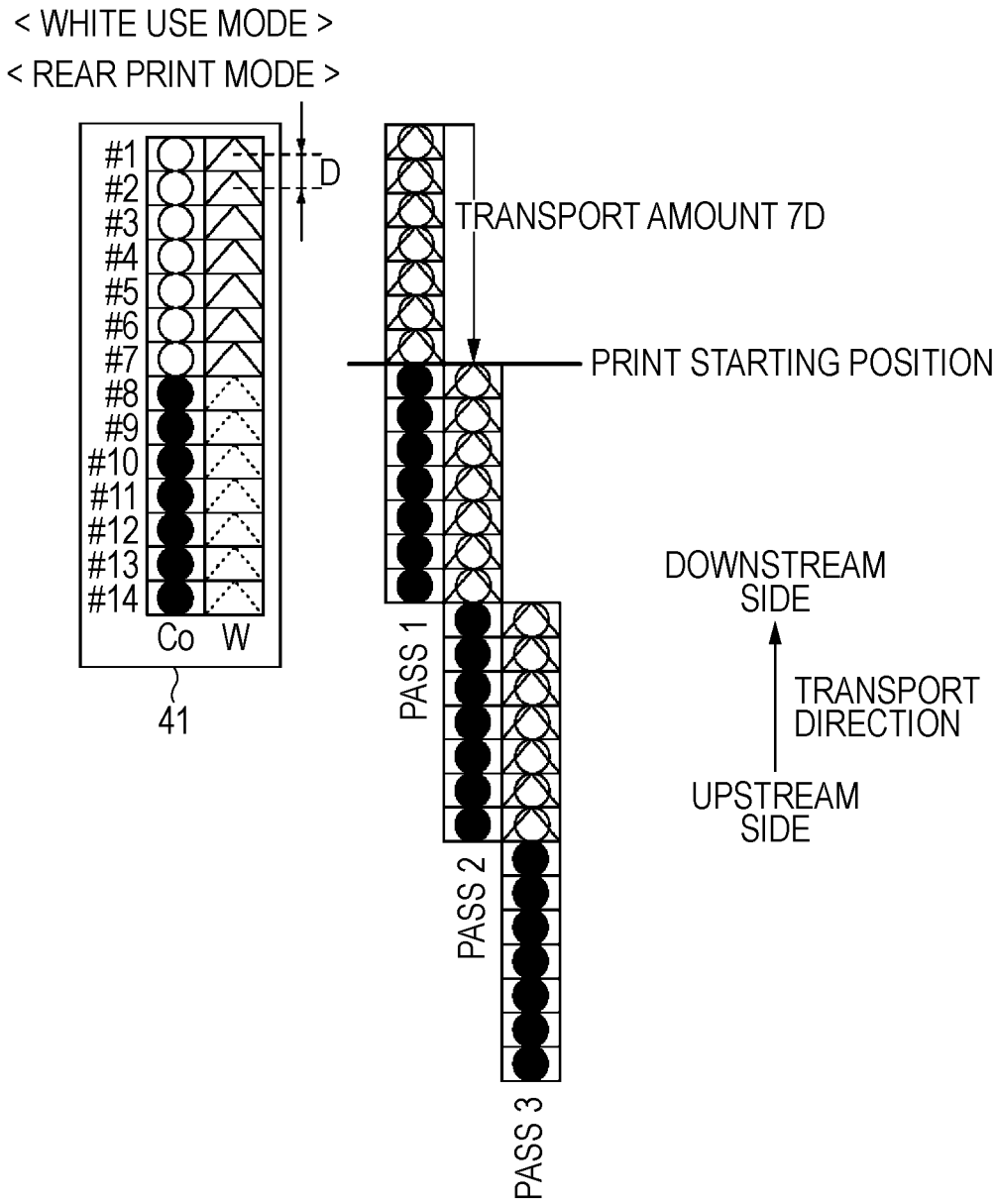
FIG. 6 is a diagram illustrating a printed example in a rear print and white use mode.

FIG. 5 is a diagram illustrating a printed example in the front print and white use mode. FIG. 6 is a diagram illustrating a printed example in the rear print and white use mode. For the simplification of the description, in the figures, the number of nozzles that belong to one nozzle row is reduced to 14. In addition, the nozzle rows respectively ejecting four color inks (YMCK) are collectively referred to as a "color nozzle row Co (corresponding to the first nozzle row)". FIGS. 5 and 6 illustrate band printing. Band printing is a printing method in which band images formed in one pass are lined up in the transport direction and a raster line is not formed in another pass inside a raster line (a dot row along the movement direction) formed in any pass.

However, when the background image is printed using only the white ink, the color itself of the white ink used for printing the background image becomes the color of the background image. However, inks called white inks at the same time may exhibit slightly different tones of white color due to materials of the ink or the like. Therefore, there may be a case where a background image with a color that a user does not want may be printed due to the white ink being used. In addition, depending on the printed matter, there may be a case where a background image with a slightly chromatic color is desired instead of simply a white color. When a white medium is used, white media also exhibit different tones of white color depending on types of the media. Accordingly, when a background is printed on a white medium, if the white color of the background image is different from the white color of the medium, the background image becomes noticeable.

Therefore, in this embodiment, a background image (a background image with adjusted white color) with the desired white color is printed appropriately using a small amount of color ink (YMCK) as well as with the white ink. That is, when the background image is to be printed, at least one from among the color inks that can be ejected by the printer 1 may be used. For example, four color inks may be used, or two color inks may be used. As described above, as the background image is printed using the white ink and the color ink, in a case where the white ink has light color, the background image is printed with ink for cancelling out the color, thereby allowing the background image to approximate an achromatic color.

In addition, print data used for printing the background image with the desired white color by the printer 1 may be stored in the printer 1 in advance or may be generated by a printer driver. When the desired color of the background image is selected by the user through a monitor of the printer 1 or a screen of the computer, print data of the background image corresponding to the selected color may be generated.

In the front print and white use mode of FIG. 5, the background image is first printed on the predetermined area of the medium, and the color image is printed thereon. Therefore, half (#8Δ to #14Δ) of the nozzles in the white nozzle row W (corresponding to the second nozzle row) on an upstream side of the transport direction and half (#8○ to #14○) of the nozzles in the color nozzle row on the upstream side of the transport direction serve as use nozzles for printing the background image, and half (#1● to #7●) of the nozzles in the color nozzle row Co on the downstream side of the transport direction serve as use nozzles for printing the color image. In addition, in the front print and white use mode, ink is not ejected from half of the nozzles (#1 to #7) in the white nozzle row W on the downstream side of the transport direction. In addition, since FIG. 5 illustrates band printing, an amount of the medium transported once corresponds to a width in the transport direction of the image formed in one pass. In the white use mode, since two types of images are formed in one pass, an amount of the medium transported once corresponds to a width in the transport direction of the background image or the color image formed in one pass. Therefore, in FIG. 5, the amount of the medium transported once is a length "7D" of the half of the nozzle row (the total length of the seven nozzles).

That is, in the front print and white use mode, an operation of forming images using the use nozzles in the white nozzle row W on the upstream side of the transport direction, the use nozzles in the color nozzle row Co on the upstream side of the transport direction, and the use nozzles in the color nozzle row Co on the downstream side of the transport direction, and an operation of transporting the medium by only the transport amount 7D are repeatedly performed. As a result, the predetermined area of the medium is opposed to the use nozzles (#8 to #14) in the white nozzle row W and the color nozzle row Co on the upstream side of the transport direction, and the background image is printed on the predetermined area of the medium. Thereafter, as the medium is transported to the downstream side of the transport direction, the predetermined area of the medium is opposed to the use nozzles (#1 to #7) in the color nozzle row Co on the downstream side of the transport direction, and the color image is printed on the background image in the predetermined area of the medium.

On the contrary, in the rear print and white use mode, as illustrated in FIG. 6, half (#1Δ to #7Δ) of the nozzles in the white nozzle row W on the downstream side of the transport direction, half (#1○ to #7○) of the nozzles in the color nozzle row Co on the downstream side of the transport direction serve as use nozzles for printing the background image, and half (#8● to #14●) of the nozzles in the color nozzle row Co on the upstream side of the transport direction serve as use nozzles for printing the color image. In addition, the amount of the medium transported once is the length 7D of half of the nozzle row. As a result, the predetermined area of the medium is first opposed to the use nozzles (#8 to #14) in the color nozzle row Co on the upstream side of the transport direction, and the color image is printed on the predetermined area of the medium. Thereafter, as the medium is transported to the downstream side of the transport direction, the predetermined area of the medium is opposed to the use nozzles (#1 to #7) in the white nozzle row W and the color nozzle row Co on the downstream side of the transport direction, and the background image is printed on the color image in the predetermined area of the medium.

As described above, a position in the transport direction of the nozzles (Δ) in the white nozzle row W for printing the background image and a position in the transport direction of the nozzles (O) in the color nozzle row Co for printing the same background image can be made to be the same. Then, in order to print the background image, white ink and color ink are ejected onto the predetermined area of the medium in the same pass. Consequently, the white ink and the color ink are mixed with each other, thereby reducing granularity of the background image.

The proportion of color ink used for constituting the background image is smaller than the proportion of white ink. Here, in order to reduce the granularity of the color ink in the background image, dots of the color ink may be dispersed as uniformly as possible. That is, a color ink density (dot density) per unit area of the background image is smaller than a white ink density (dot density) per unit area of the background image. Therefore, although the proportion of the color ink used for constituting the background image is smaller than the proportion of the white ink, in this embodiment, the number of nozzles in the white nozzle row W and the number nozzles in the color nozzle row Co, which are used for printing the background image, are equal to each other. That is, the background image is printed using the half of the nozzles that belong to the color nozzle row Co. However, the invention is not limited thereto, and the background image may be printed using nozzles at intervals from among the half of the nozzles in the color nozzle row Co that can be used for printing the background image.

In the white use mode as described above, the use nozzles for the image to be printed first from among the color image and the background image, may be set as the nozzles which are closer to the upstream side of the transport direction than the use nozzles for the image to be printed subsequently. Accordingly, the images may be printed in the order corresponding to the front print or the rear print mode. In addition, a pass in which the background image is printed on the predetermined area of the medium may be set to be different from a pass in which the color image is printed. In this case, a relatively long time to dry until the subsequent image is printed after the preceding image is printed can be acquired, thereby suppressing oozing of the image.

Suitable Print Pattern Per Image Quality Level

FIG. 7 is a diagram illustrating an evaluation result of print patterns 1 to 5 of adoption candidates of an image quality level 2. FIGS. 8 to 12 are diagrams for explaining the print patterns 1 to 5 of the adoption candidates of the image quality level 2. In the printer 1 according to this embodiment, the user may select one from among 3 types of print modes (image quality levels) including a "sharp mode", a "normal mode", and a "quick mode" depending on the use. Images with higher quality can be printed in the order of the sharp mode (image quality level 1), the normal mode (image quality level 2), and the quick mode (image quality level 3). On the other hand, the image can be performed at higher speed in the order of the quick mode, the normal mode, and the sharp mode. Therefore, the print patterns (corresponding to the printing method and the dot formation method) in the image quality levels 1 to 3 are different from each other.

The printer 1 can print a number of print patterns, and even when an image is printed at the same image quality level, a plurality of types of print patterns may be performed. For example, the printer 1 may perform the five print patterns 1 to 5 as the print patterns for printing the image at the image quality level 2 as illustrated in FIG. 7. In the print patterns 1 to 5 for performing printing at the same degree of image quality, image quality (slightly) varies due to characteristics of the head 41 (nozzles), transport characteristics of the medium, and characteristics of various components in the printer 1. Therefore, there may be a case where, even in the same type of printer as well as different types of printers, print patterns in which printing can be performed at highest image quality vary in the print patterns 1 to 5 in which printing is performed at the same degree of image quality. For example, from among the print patterns 1 to 5 in which an image is printed at the image quality level 2, image quality of the image printed in the print pattern 2 is highest in a printer 1, or image quality of the image printed in the print pattern 4 is highest in a different printer.

In this embodiment, in a manufacturing process of the printer 1, an optimal print pattern is determined for the printer 1 in each of the image quality levels 1 to 3. Here, as evaluation criteria for determining the optimal print pattern, as illustrated in FIG. 7, there are image quality of the printed image and print speed. In addition, the manufacturing process includes at least any one of a design process and a mass production process. Here, the optimal print pattern is determined depending on the differences between the image quality characteristics of individual printers 1. That is, the optimal print pattern is determined in the mass production process. However, the invention is not limited thereto, and the optimal print pattern may be determined depending on differences between image quality characteristics of types of the printers 1, that is, in the design process.

Hereinafter, a method of determining the optimal print pattern in the image quality level 2 will be exemplified. As described above, candidate print patterns of the image quality level 2 are 5 types of print patterns 1 to 5. First, the print patterns 1 to 5 will be described in detail.

Figure 8:
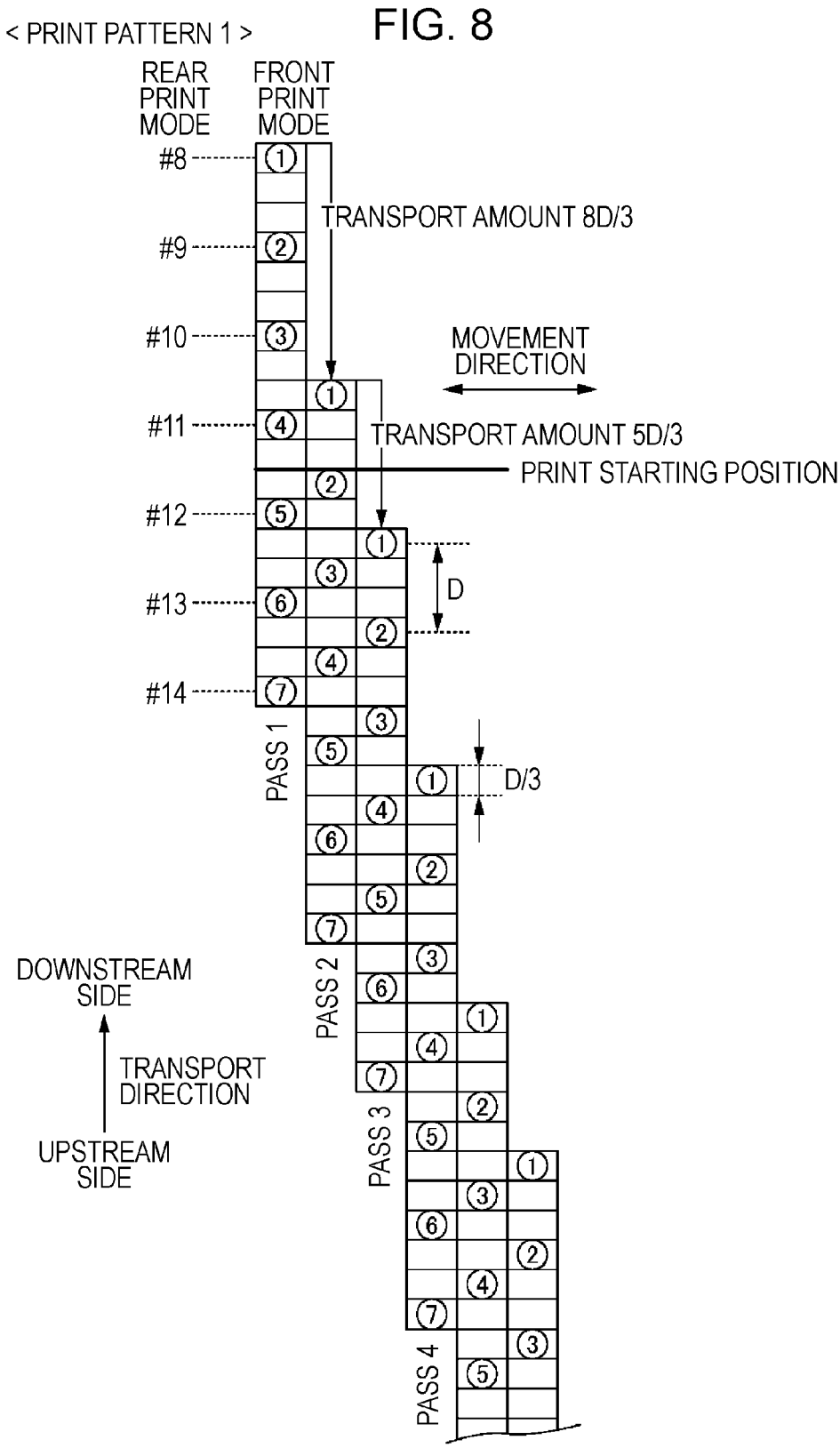
FIG. 8 is a diagram for explaining the print pattern 1.

FIG. 8 is a diagram for explaining the print pattern 1. In FIG. 8, a positional relationship of the color nozzle row Co between passes, and the number of nozzles that belong to the color nozzle row Co is set to 14. In addition, in the following description, printing in the front print and white use mode will be exemplified. In the front print and white use mode, as illustrated in FIG. 5, the half #1 to #7 of the nozzles on the downstream side of the transport direction from among the nozzles that belong to the color nozzle row Co serve as the use nozzles. Therefore, in FIG. 8, a type of printing using the color nozzles #1 to #7 is illustrated (numbers in circles in the figure denote nozzle numbers). The non-use nozzles #8 to #14 which are the half of the color nozzle row Co on the upstream side, and the white nozzle row W are not shown. In addition, the print pattern formed by the color nozzles and the print pattern formed by the white nozzles are the same.

In the print pattern 1, a single raster line is formed by a single nozzle. Therefore, as illustrated in FIG. 8, a plurality of the nozzles is not lined up in the movement direction. In addition, a print resolution in the transport direction is set to a resolution (for example, 540 dpi) which is three times a nozzle pitch D (for example, 180 dpi) of the color nozzle row Co. That is, two raster lines are printed in the raster line formed in one pass. To perform printing as described above, the amount of the medium transported once becomes a "repetition of 8D/3, 8D/3, and 5D/3". In the figures, since the number of nozzles that belong to a single nozzle row is reduced, the amount of the medium transported once is shortened. However, in actual fact, there are many nozzles that belong to a single nozzle row, so that according to this the actual medium transport amount is determined.

The front print and white use mode and the rear print and white use mode are different from each other in that (positions of) nozzles used in the color nozzle row Co are different; however, the number of nozzles used and the medium transport amount are the same if the print pattern is the same. Therefore, as illustrated in FIG. 8, the color nozzle #1 in the front print mode corresponds to the color nozzle #8 in the rear print mode, and the color nozzle #2 in the front print mode corresponds to the dolor nozzle #9 in the rear print mode. Therefore, the description of the rear print mode will be omitted.

Figure 9:
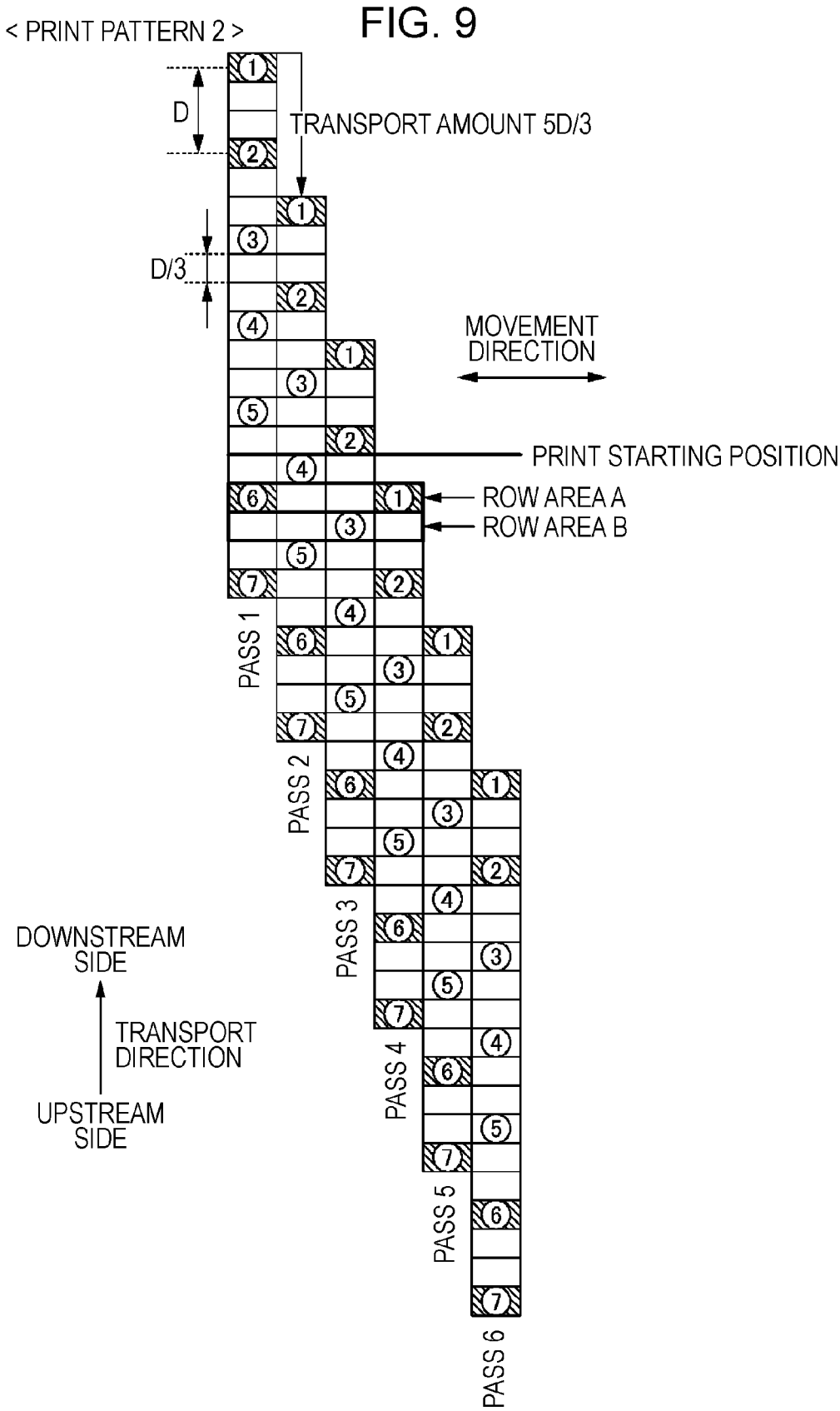
FIG. 9 is a diagram for explaining the print pattern 2.

FIG. 9 is a diagram for explaining the print pattern 2. In the print pattern 2, a part of a raster line is printed using two nozzles (so-called partial overlap printing). In the use nozzles #1 to #7 of the color nozzle row Co, two nozzles from among the two nozzles #1 and #2 at an end on the downstream side and the two nozzles #6 and #7 at an end on the upstream side are used for printing one raster line. In addition, the print resolution in the transport direction is the same as that of the print pattern 1. Accordingly, in the print pattern 2, the amount of the medium transported once is "5D/3".

As a result, for example, the two nozzles #6 and #1 may be allocated to a row area A on the medium on which the raster line is to be formed, and the one nozzle #3 may be allocated to a row area B on which another raster line is to be formed. In the area where two nozzles can be applied to a single row area, even though one nozzle is a defective nozzle having different ejection characteristics including an ejection amount or ejection direction different from design values, dots can be formed using the other nozzle. Therefore, it is possible to lessen and suppress the generation of white stripes on the image.

Figure 10:
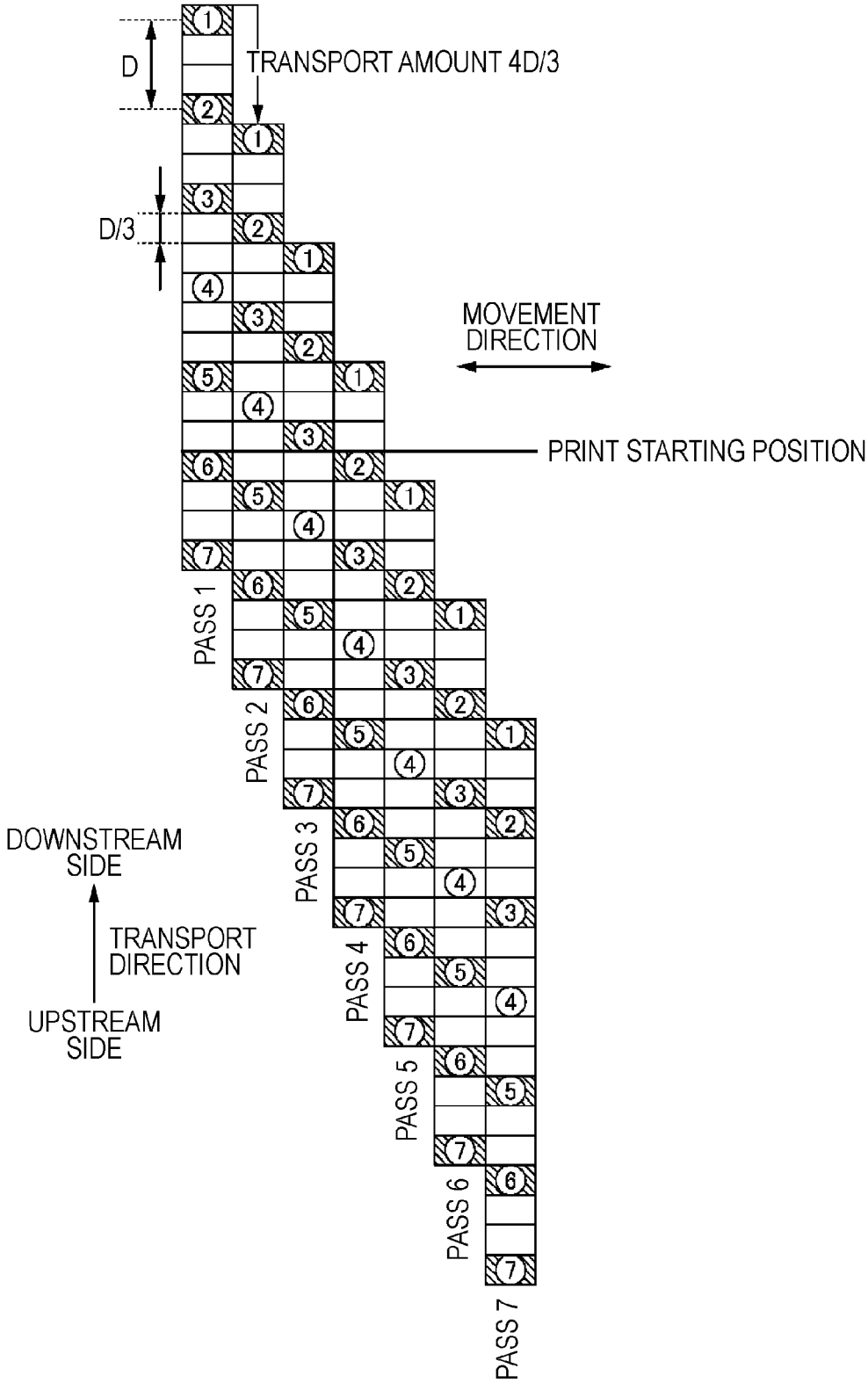
FIG. 10 is a diagram for explaining the print pattern 3.

FIG. 10 is a diagram for explaining the print pattern 3. In the print pattern 3, the number of raster lines formed by two nozzles is increased compared to the print pattern 2. In the use nozzles #1 to #7 of the color nozzle row Co, two nozzles from among the three nozzles #1 to #3 at the end on the downstream side and the three nozzles #5 to #7 at the end on the upstream side are used for printing one raster line. In addition, the print resolution in the transport direction is the same as those of the print patterns 1 and 2, and the amount of the medium transported once in the print pattern 3 is "4D/3".

Figure 11:
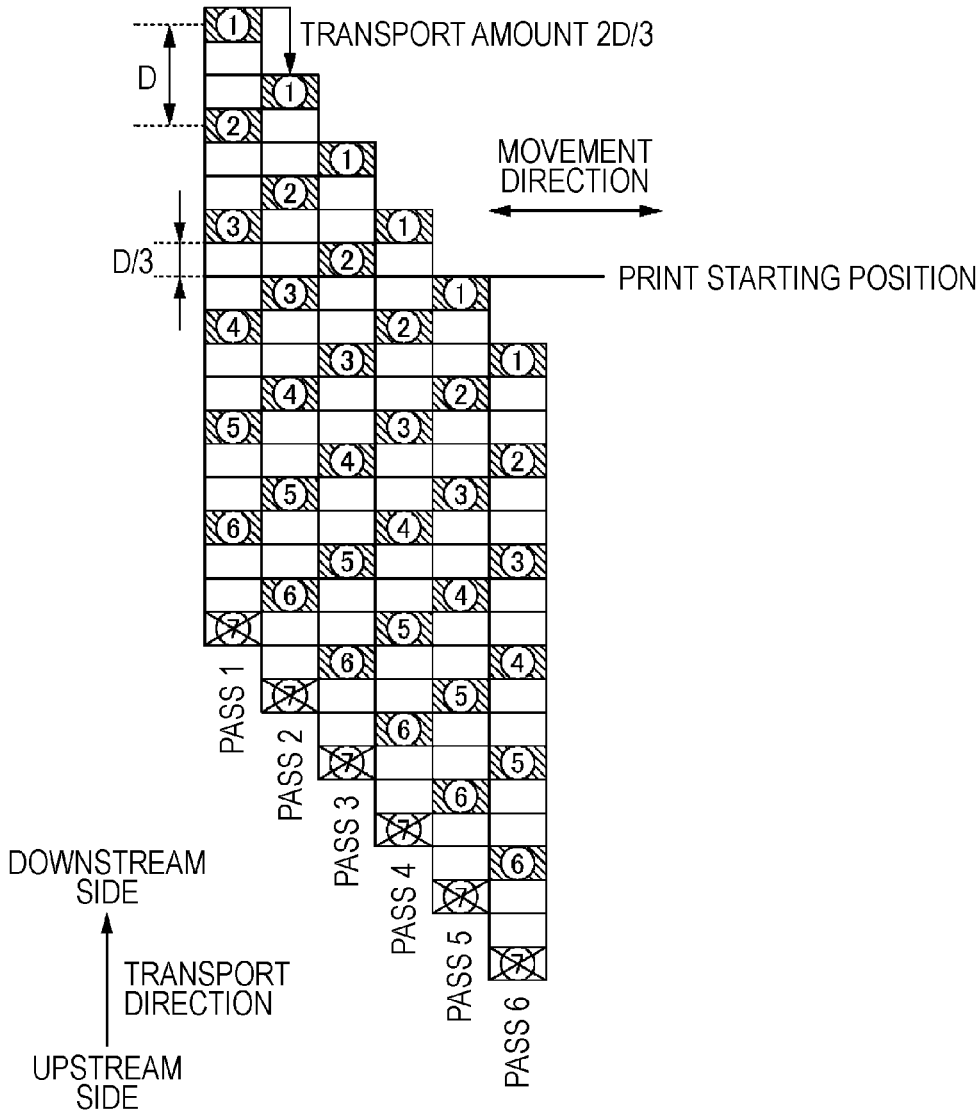
FIG. 11 is a diagram for explaining the print pattern 4.

FIG. 11 is a diagram for explaining the print pattern 4. In the print pattern 4, all raster lines are formed by a plurality of the nozzles. Consequently, even when a nozzle in the color nozzle row Co is a defective nozzle, it is possible to suppress the generation of white stripes on the image. In addition, the print resolution in the transport direction is the same as those of the print patterns 1 to 3, and the amount of the medium transported once in the print pattern 4 is "2D/3". Since all raster lines are formed by the plurality of the nozzles in the print pattern 4, the amount of the medium transported once is relatively small, and from among the half #1 to #7 of the nozzles in the color nozzle row Co, there are nozzles that do not need to be used. For example, in FIG. 11, the nozzle #7 serves as the non-use nozzle.

In addition, when there are non-use nozzles due to the medium transport amount and the overlap number (the number of nozzles used for forming a single raster line), nozzles between the color nozzle row Co and the white use nozzle row W may serve as the non-use nozzles. In addition, a length in the transport direction of the area that the non-use nozzles belong to is an integral multiple of the medium transport amount. Accordingly, for the entire area of the image, a pass (a predetermined drying time) in which printing is not performed can be provided between the color image and the background image, thereby suppressing density unevenness of the image.

Figure 12:
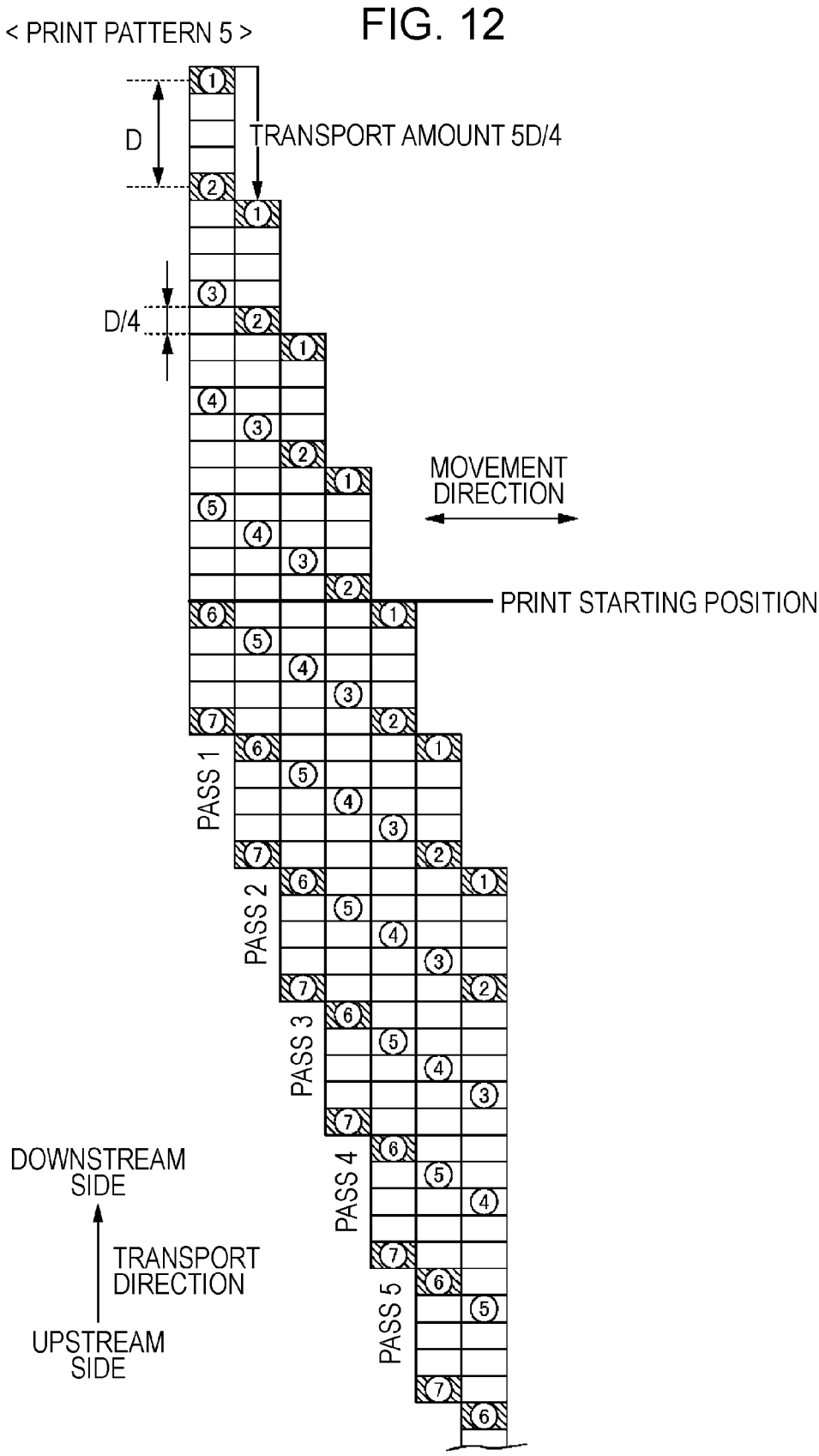
FIG. 12 is a diagram for explaining the print pattern 5.

FIG. 12 is a diagram for explaining the print pattern 5. The print resolutions in the transport direction in the print patterns 1 to 4 are equal to each other and have a value that is three times the nozzle pitch D of the color nozzle row Co. On the other hand, in the print pattern 5, the print resolution in the transport direction is further increased to a resolution that is four times the nozzle pitch D of the color nozzle row Co. That is, three raster lines are printed in the raster line formed in one pass. In addition, in the print pattern 5, the partial overlap printing is also performed as in the print pattern 2. In the use nozzles of the color nozzle row Co, two nozzles from among the two nozzles #1 and #2 at the end on the downstream side and the two nozzles #6 and #7 at the end on the upstream side are used for printing one raster line. Accordingly, in the print pattern 5, the amount of the medium transported once is "5D/4".

In general, as the number of raster lines formed by a plurality of nozzles is increased or the print resolution is enhanced, the print speed is decreased, and image quality is improved. However, positions at which defective nozzles are included vary in printers 1. Therefore, even in the print patterns 2 and 3 in which parts of the raster line are printed by overlapping the plurality of nozzles, when the defective nozzles are incidentally allocated so that they do not overlap in the same row area, the print patterns 1 to 3 have substantially the same degree of image quality even though the print patterns 2 and 3 in which the partial overlap printing is performed have lower print speeds than that of the print pattern 1. In addition, when the printer 1 without defective nozzles selects a print pattern for printing one raster line with a plurality of nozzles or selects a print pattern with high print resolution, the print speed is unnecessarily lowered. In addition, due to characteristics of the transporting unit 20 of printer 1, transport characteristics (for example, a method of causing a transport error) of the medium vary. Then, connection or the like of the images in each print pattern is different depending on the printer 1, so that the optimal print patterns also vary.

That is, due to characteristics of the printer 1 (the head 41, the transporting unit 20, and the like), the optimal print pattern (a print pattern in which the image quality is as high as possible and the print speed is as fast as possible) varies in the print patterns 1 to 5 for performing printing at substantially the same degree of image quality. In addition, print patterns (dot formation methods) are different in that at least one of the medium transport amount, (the number or positions of) nozzles used for printing an image, the print resolution, the number of raster lines formed by the plurality of nozzles, the number of nozzles used for forming one raster line, and the like varies.

Here, in this embodiment, in order to determine the optimal print pattern from among the 5 types of print patterns 1 to 5, in the manufacturing process (inspection process), an inspector allows the printer 1 to print the 5 print patterns 1 to 5 (not shown) as test patterns in the front print and white used mode. That is, 5 test patterns in which color images are printed on the background image are formed. The inspector views the color images of the 5 test patterns on the printed surface side and evaluates image quality. In addition, although the background images are printed in the test patterns since the test patterns are printed in the white use mode, the image quality is evaluated for the color images.

As illustrated in FIG. 7, the image quality is evaluated at three levels. Very good image quality is evaluated as "◎", good image quality is evaluated as "○", and normal image quality is evaluated as "Δ". According to the evaluation result of FIG. 7 in the front print and white use mode, the print patterns 1 and 2 are evaluated as normal (Δ), the print patterns 3 and 4 are evaluated as good (○), and the result of the print pattern 5 is very good (◎). In addition, the print speeds, for the amounts of the medium transported once in the print patterns 1 to 5, are fastest in the print pattern 1, and then in descending order of the print pattern 2, the print pattern 3, the print pattern 5, and the print pattern 4.

Similarly, the inspector allows test patterns to be printed as the 5 print patterns 1 to 5 in the rear print and white use mode by the printer 1 to be inspected. That is, 5 test patterns in which color images are printed on transparent media and background images are printed on the color images are formed. The inspector views the color images in the 5 test patterns on the medium side and evaluates image quality. According to the evaluation result of FIG. 7 in the rear print and white use mode, the print pattern 1 is evaluated as normal (Δ), the print pattern 2 is evaluated as good (○), and the results of the print patterns 3 to 5 are very good (◎). In addition, the print speeds in the rear print and white use mode are the same as those in the front print and white use mode.

In the case where the evaluation result of FIG. 7 is obtained, for example, in the front print and white use mode, the print pattern 5 in which the image quality is evaluated as best and the print speed is fourth may be determined as the optimal print pattern. In the rear print and white use mode, from among the print patterns 3 to 5 with good image quality evaluation, the print pattern 3 of which print speed is fastest may be determined as the optimal print pattern. In addition, for the remaining image quality levels 1 and 3, test patterns may be printed as candidate print patterns by the printer 1 to determine the optimal print patterns.

As described above, in this embodiment, with regard to the white use mode, the test patterns are printed by the printer 1 in both the front print mode and the rear print mode to determine the optimal print pattern. This is because in the front print mode the half of the nozzles on the downstream side of the transport direction from among the nozzles that belong to the color nozzle row Co is used (exemplified in FIG. 5) and in the rear print mode the half of the nozzles on the upstream side of the transport direction from among the nozzles that belong to the color nozzle row Co is used (exemplified in FIG. 6) in the printer 1. That is, even in the same white use mode, the front print mode and the rear print mode use different nozzles for printing the color images, and defective nozzles result in different ways, so that the optimal print patterns are different.

Furthermore, the color image is directly viewed in the front print mode; on the contrary, the color image is viewed via the medium in the rear print mode. Therefore, generally, it is difficult for low image quality to be seen in the rear print mode compared to the front print mode. With regard to the example of the evaluation result shown in FIG. 7, in comparison between the front print mode and the rear print mode with the same print patterns, the image quality evaluation of the rear print mode is better than the image quality evaluation of the front print mode. Accordingly, according to this embodiment, even when printing is performed in the same white use mode at the same image quality level, the optimal print pattern of the front print mode and the optimal print pattern of the rear print mode are individually set. That is, the print pattern (the dot formation method) used for printing the color image in the front print mode is different from the print pattern used for printing the color image in the rear print mode (different in at least one of the medium transport amount, the nozzles used for printing images, the print resolution, the overlapping method, and the like).

However, the printer 1 according to this embodiment has the color mode in addition to the white use mode as illustrated in FIG. 4. Since only the color image is printed in the color mode, it is possible to print the color image using all nozzles that belong to the color nozzle row Co. Here, it is assumed that all the nozzles that belong to the color nozzle row Co are used in the color mode. In this case, since the half of the nozzles in the color nozzle row Co is used in the white use mode, the color nozzles used for printing the color image in the white use mode are different from the color nozzles used for printing the color image in the color mode (in the type and the number of the nozzles). Therefore, since the positions at which defective nozzles occur, the medium transport amounts, and the like vary, there may be a case where the optimal print patterns in the white use mode and the color mode are different from each other. Accordingly, even in the color mode, similarly to the white use mode, the optimal print pattern has to be determined by printing test patterns. Specifically, in order to set the optimal print pattern from among the candidate print patterns 1 to 5 at the image quality level 2, the inspector allows the printer 1 to print the test pattern for each of the print patterns 1 to 5 in the front print and color mode (using all the nozzles that belong to the color nozzle row Co) and evaluates image quality. In addition, the inspector allows the printer 1 to print the test pattern for each of the print patterns 1 to 5 in the rear print and color mode and evaluates image quality. The inspector determines the optimal print pattern of the front print and color mode and the optimal print pattern of the rear print and color mode on the basis of the image quality evaluation. Then, the manufacturing process of the printer 1 becomes complex, and a long inspection time is needed to determine the optimal print pattern.

Here, in the printer 1 according to this embodiment, (the positions and the number of) the use nozzles for printing the color image in the color mode are the same as (the positions and the number of) the use nozzles for printing the color image in the white use mode. Moreover, the use nozzles for printing the color image in the "front print and color mode" are the same as the use nozzles (#1 to #7) for printing the color image in the "front print and white use mode", and the use nozzles for printing the color image in the "rear print and color mode" are the same as the use nozzles (#8 to #14) for printing the color image in the "rear print and white use mode".

In this manner, the print pattern of the color image in the "front print and color mode" and the print pattern of the color image in the "front print and white use mode" can be made to be the same (in the use nozzles, the medium transport amount, and the number of nozzles for forming one raster line) (except a difference in existence of the background image). In addition, the print pattern of the color image in the "rear print and color mode" and the print pattern of the color image in the "rear print and white use mode" can be made to be the same. Therefore, the optimal print pattern determined according to the test pattern result in the "front print and white use mode" can be employed as the optimal print pattern in the "front print and color mode", and the optimal print pattern determined according to the test pattern result in the "rear print and white use mode" can be employed as the optimal print pattern in the "rear print and color mode".

That is, in the printer 1 according to this embodiment, the print pattern of the "front print and color mode" and the print pattern of the "front print and white use mode" can be made to be the same, and the print pattern of the "rear print and color mode" and the print pattern of the "rear print and white use mode" can be made to be the same. As a result, in the manufacturing process, there is no need to print the test pattern for each of the print patterns 1 to 5 in the color mode using the printer 1. In addition, there is no need to evaluate the test pattern result, thereby simplifying the manufacturing process.

FIG. 13 shows a print pattern table stored in the memory 13 of the printer 1. In the manufacturing process of the printer 1, for each of the image quality levels 1 to 3, the optimal print pattern of the front print and white use mode is determined (according to the result in FIG. 7, the print pattern 5 is employed at the image quality level 2), and the optimal print pattern of the rear print and white use mode is determined (the print pattern 3 is employed). In addition, in the print pattern table, information needed to perform the print pattern set for each mode (the use nozzles, the medium transport amount, the method of distributing pixels when one raster line is printed using a plurality of nozzles) is stored.

In this embodiment, since the same print pattern is employed in the "front print and color mode" and the "front print and white use mode", information common to the front print and color mode and the front print and white use mode is stored. Similarly, since the same print pattern is employed in the "rear print and color mode" and the "rear print and white use mode", information common to the rear print and color mode and the rear print and white use mode is stored. In addition, since a background image is not printed in the color mode while the background image is printed in the white use mode, the fact that white nozzles also serve as the use nozzles in the white use mode while the white nozzles do not serve as the use nozzles in the color mode is stored.

As described above, the same print pattern is used in the front print and color mode and the front print and white use mode, and information used for performing the print pattern is stored as the common information. In addition, the same print pattern is used in the rear print and color mode and the rear print and white use mode, and information used for performing the print pattern is stored as the common information, thereby lowering the necessary storage capacity of the memory 13.

In addition, as the nozzles and the print pattern for printing the color image in the white use mode can be made to the same as the nozzles and the print pattern for printing the color image in the color mode, the image quality of the color image can be checked by printing the color image in the color mode before performing printing in the white use in practice. Since the same color nozzles are used in the white use mode and the color mode, for example, when color nozzles which cause discharge failure are checked as the print result in the color mode, printing is performed in practice after cleaning the color nozzles, and thus tones of the color image can be adjusted. Since the white ink tends to be more expensive than the color ink, consumption of the white ink can be suppressed by checking the image quality of the color image in the color mode before practical use. In addition, at that time, a transparent medium may be used in the white use mode in practice, and the color image may be printed in a white medium in the color mode.

In addition, according to this embodiment, in order to share the print pattern between the color mode and the white use mode, the half of the nozzles in the color nozzle row Co serve as the use nozzles even in the color mode similarly to the white use mode. However, in the printer 1, a transporting roller is provided closer to the upstream side in the transport direction than the head 41, and a discharging roller is provided on the downstream side of the transport direction (not shown). In order to perform printing on the center portion of the medium, the printing is performed while the medium is pinched by the two rollers. Here, the medium is suppressed from being raised from a platen which supports the medium from below. However, during printing on an upper end, the medium is pinched only by the transporting roller, and during printing on a lower end, the medium is pinched only by the discharging roller. Here, there are concerns that the medium is likely to be raised from the platen, and a distance (platen gap) from the nozzle surface of the head 41 to the medium may be changed in the nozzle row direction such that dot landing positions are deviated. Here, as the nozzle row is lengthened, an amount of the platen gap changed is increased. Therefore, as in this embodiment, the half of the nozzles in the color nozzle row Co are used as the use nozzles even in the color mode similarly to the white use mode, thereby reducing the amount of the platen gap changed during the printing on the upper and lower ends and thus suppressing deviation of the dot landing positions. In addition, it is assumed that the printer 1 has an adjustment value for correcting the deviation of the dot landing positions for the change in the platen gap which may occur when the medium is pinched by the roller on only one side. In this case, the color nozzles used in the color mode and white use mode can be made to be the same, thereby sharing the adjustment value for correcting the deviation of the dot landing positions for the change in the platen gap.

According to this embodiment, in order to determine the optimal print pattern of each of the image quality levels 1 to 3, the image quality of the color image overlapped on the background image is evaluated by printing the test patterns in the white use mode. That is, the optimal print pattern in the white use mode is employed by the color mode. However, the invention is not limited thereto, and the optimal print pattern in the color mode may be employed in the white use mode by evaluating the color image printed in the color mode. Since the white ink tends to be more expensive than the color ink, the test patterns are printed in the color mode to determine the optimal print pattern, which reduces cost in the manufacturing process. In addition, for example, when the white mode is more frequently used than the color mode, the test patterns are printed in the white mode to determine the optimal print pattern. As such, the optimal print pattern may be determined in the mode that is more frequently used.

In addition, the printer 1 according to this embodiment has the front print mode and the rear print mode for each of the white use mode and the color mode; however, the invention is not limited thereto. Instead, the printer 1 may have only one mode from among the front print mode and the rear print mode. For example, when only the front print mode is provided, the print pattern (color use nozzles) of the front print and white use mode and the print pattern (color use nozzles) of the front print and color mode may be used in common.

In addition, in the color mode, there is not restriction on the positions of the use nozzles, so that the print pattern of the color mode may be used as the print pattern of the front print and white use mode, or as the print pattern of the rear print and white use mode. Therefore, the print pattern (color use nozzles) of the front print and white use mode may be employed as the print pattern (color use nozzles) of both the rear print and front print color modes. On the contrary, the print pattern (color use nozzles) of the rear print and white use mode may be employed as the print pattern (color use nozzles) of both the rear print and front print color modes. However, as described above, since pixels for front printing and rear printing are different from each other, when the color nozzles used in the color mode (both the front rear print modes) are set to either the half of the nozzles on the upstream side in the transport direction (the nozzles of the rear print and white use mode) or the half of the nozzles on the downstream side of the transport direction (the nozzles of the front print and white use mode), there is a possibility that one of the front printing and the rear printing in the color mode has degraded image quality compared to the other. In addition, there is an inclination in frequencies of the color nozzles used, and thus there is a concern that the life span of the color nozzle row Co is reduced. Therefore, in this embodiment, the print pattern (color use nozzles) of the front print and color mode and the print pattern (color use nozzles) of the front print and white use mode are used in common, and the print pattern (color use nozzles) of the rear print and white use mode and the print pattern (color use nozzles) of the rear print and color mode are used in common.

The printer according to this embodiment enables printing at the three image quality levels 1 to 3 as illustrated in FIG. 13. However, the invention is not limited thereto, and a printer for performing printing at a single image quality level may be used. In addition, with regard to the white use mode, for example, as illustrated in FIGS. 5 and 6, the number of white nozzles used for printing the background image and the number of color nozzles used for printing the color image are equal to each other to print the same print pattern; however, the invention is not limited thereto. The number of color nozzles used for printing the color image may be set to be greater than the number of white nozzles used for printing the background image. Since the background image does not need to be printed at high image quality compared to the color image, the print resolution in the transport direction may be reduced by the reduction in the number of nozzles for printing the background image. In addition, non-use nozzles may be provided between the use nozzles in the color nozzle row Co for the color image and the use nozzles in the white nozzle row W for the background image. Accordingly, a pass in which ink is not ejected can be provided while two images are printed on a predetermined area of a medium, thereby ensuring a longer drying time. As a result, oozing of the ink can be suppressed. Furthermore, the number of non-use nozzles is set to the number of nozzles that belong to an area of which a length in the transport direction is an integer multiple of the transport amount. Thus, the drying time of the entire image can be constant (the number of passes opposed to the non-use nozzles is constant independently of the position of the medium), thereby suppressing density unevenness of the image.

In this embodiment, the 5 print patterns 1 to 5 are shown as print candidates of the image quality level 2. The print patterns 1 to 4 have the same constant print resolution in the transport direction (FIGS. 8 to 11); however, the print pattern 5 has a higher print resolution in the transport direction than the print patterns 1 to 4. That is, in this embodiment, even when the print resolutions are different, the print patterns 1 to 4 and the print pattern 5 are printed at the same level of image quality, so that the print pattern 5 is included as a candidate print pattern at the same image quality level 2. Here, there may be a case where image quality is significantly changed as the print resolution is different, and thus the print resolution is fixed in a printer driver in response to a print mode (a sharp mode or a quick mode) (that is, at the same image quality level). In this case, a print pattern (here, the print pattern 5) having a different print resolution may not be included in candidate print patterns at the same image quality level.

PRINTING EXAMPLES

The printer driver determines, when receiving a print command from a user, whether printing is to be performed in the "white use mode" or the "color mode" and whether the printing is to be performed in the "front print mode" or the "rear print mode". Thereafter, the printer driver generates print data to allow the printer 1 to print an image in response to the determined print mode. Thereafter, the printer driver transmits command data (the print mode, the type of the medium, and the like) along with the generated print data to the printer 1. A print pattern setting unit 141 in the controller 10 of the printer 1 sets a print pattern in response to the print mode with reference to a print pattern table (FIG. 13) stored in the memory 13 on the basis of the information from the printer driver. Accordingly, the controller 10 controls each unit (the transporting unit 20, the head unit 40, and the like) to perform printing with use nozzles and at a transport amount corresponding to the set print pattern. Therefore, the controller 10 of the printer 1 corresponds to a control unit, and the printer 1 corresponds to a fluid ejecting apparatus. Hereinafter, a flow for setting the print pattern at the image quality level 2 in response to the print mode by the print pattern setting unit 141 will be described.

Example 1

Figure 14:
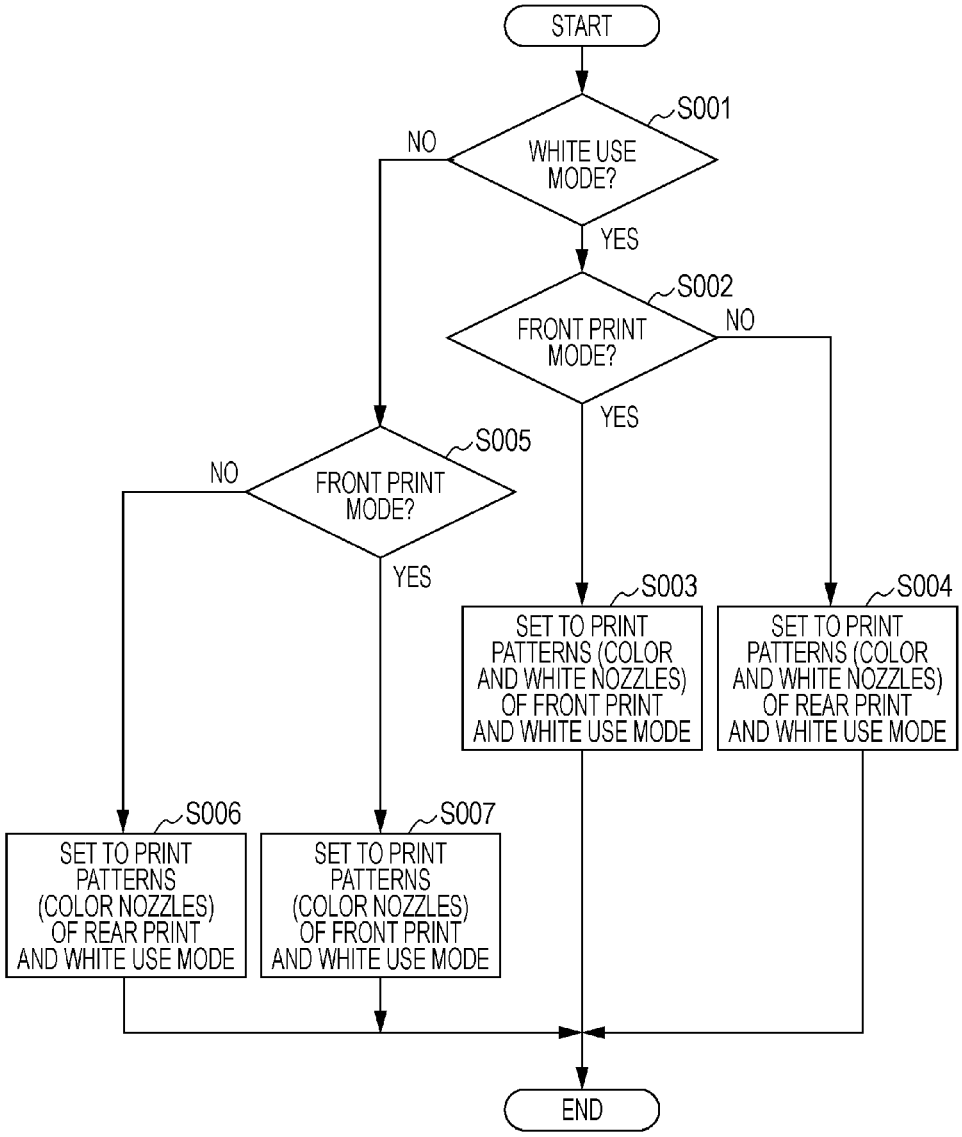
FIG. 14 is a diagram for explaining a setting flow of a print pattern according to Example 1.

FIG. 14 is a diagram for explaining a setting flow of a print pattern according to Example 1. The print pattern setting unit 141, first, determines an image quality level (not shown). Next, the print pattern setting unit 141 determines whether or not printing is to be performed in the white use mode on the basis of the information on the print mode (the command data) transmitted from the printer driver (S001). In the case of the white use mode (Yes in S001), the print pattern setting unit 141 determines whether or not printing is to be performed in the front print mode (S002). In the case of the front print mode (Yes in S002), the print pattern setting unit 141 sets a print pattern to the print pattern 5 determined as the test pattern result of the front print and white use mode with reference to the print pattern table (data at the image quality level 2) of FIG. 13 (S003). In the case of not the front print mode (No in S002), the print pattern setting unit 141 sets a print pattern to the print pattern 3 determined as the test pattern result of the rear print and white use mode (S004). In the case of the white use mode, ink droplets are ejected from both the color use nozzles and the white use nozzles.

On the other hand, at first, when it is determined that printing is not performed in the white use mode (No in S001), the print pattern setting unit 141 determines whether or not printing is to be performed in the front print mode in the next operation (S005). In the case of the front print mode (Yes in S005), the print pattern setting unit 141 sets a print pattern to the print pattern 5 determined as the test pattern result of the front print and white use mode (S007). Here, ink droplets are not ejected from the white use nozzles (#8 to #14 in W). In the case of not the front print mode (No in S005), the print pattern setting unit 141 sets a print pattern to the print pattern 3 determined as the test pattern result of the rear print and white use mode (S006). Here, ink droplets are not ejected from the white use nozzles (#1 to #7 in W).

Accordingly, the printer 1 can perform printing in the suitable print pattern (use nozzles) in each print mode. That is, in the front print mode, the print pattern suitable for using the color nozzles (#1 to #7) on the downstream side of the transport direction is set, and in the rear print mode, the print pattern suitable for using the color nozzles (#8 to #14) on the upstream side of the transport direction is set. As a result, printing can be performed in the print pattern which achieves good image quality and high print speed.

Moreover, the invention is not limited to the situation where the user is allowed to select a print mode when the printer driver receives a print command from the user. For example, the print mode may be set to a default value to enable the user to change the print mode as needed. In addition, the print pattern setting unit 141 may set a print mode when the printer driver receives print data, the printer driver may generate the print data in response to the print mode set by the print pattern setting unit 141, or the controller 10 of the printer 1 may generate print data by setting a print mode. In addition, the print pattern (use nozzles) set to the default value according to the flow of FIG. 14 may be changed by the user (for example, after the print pattern of the front print and white use mode is set in S007 in FIG. 14, the print pattern may be changed as the print pattern of the rear print and white use mode by the user).

In addition, the printer driver may set a print pattern in response to the print mode and with reference to the print pattern table (FIG. 13) stored in the memory 13 of the printer 1. In this case, the computer 60 in which the printer driver is installed corresponds to the control unit, and a printing system connected to the printer 1 with the computer 60 corresponds to the fluid ejecting apparatus.

In addition, the invention is not limited to the flow of FIG. 14. For example, as a result of the determination of whether or not the print pattern setting unit 141 is in the white use mode, in the case of the color mode (No in S001), the print pattern setting unit 141 may determine that the front print mode is to be set. In the case of performing printing in the rear print mode, the medium is transparent, and the opposite side on which the background image is not printed as well as the color image may be transparent. Therefore, in the case of the color mode (in the case where the background image is not printed), the print pattern setting unit 141 may determine that printing is performed in the front print mode since the medium is not a transparent medium, and automatically set a print pattern to the print pattern 5. In this case, the printer driver allows the user to select the white use mode or the color mode, and when the color mode is selected, the printer driver may first determine that printing is performed in the front print mode.

In addition, in the flow of FIG. 14, the print pattern setting unit 141 first determines whether or not printing is to be performed in the white use mode. However, the invention is not limited thereto, and whether or not printing is to be performed in the front print mode may be first determined. Further, in this case, when the print pattern setting unit 141 first determines that printing is to be in the rear print mode, since there is a concern that the medium is transparent and the opposite side is transparent, the white use mode may be determined. On the other hand, when the print pattern setting unit 141 first determines that printing is to be performed in the front print mode, since there is a low possibility that the medium is a transparent medium and the background image does not need to be printed, the color mode may be determined. In addition, when the print pattern setting unit 141 first determines that printing is to be performed in the front print mode, if the printing medium is a transparent medium, the white use mode may be determined. If the printing medium is an opaque medium, the color mode may be determined. Furthermore, when the print pattern setting unit 141 determines that printing is to be performed in the front print mode on an opaque medium, if the printing medium is white, the color mode is determined. If the printing medium is not white, the white use mode is determined. Even in this case, the printer driver may be allowed to perform the same print mode determination method as the print pattern setting unit 141.

Example 2

Figure 15:
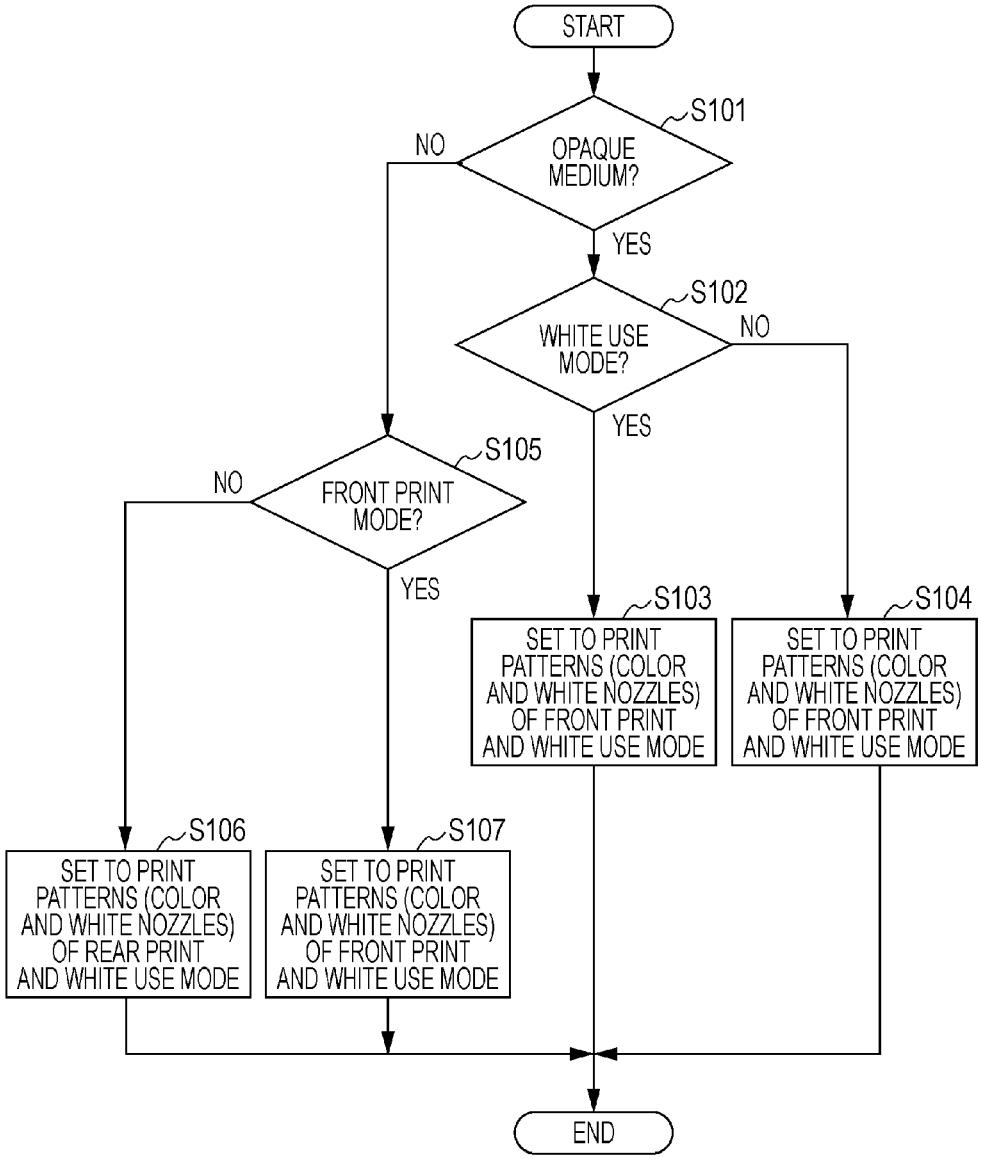
FIG. 15 is a diagram for explaining a setting flow of a print pattern according to Example 2.

FIG. 15 is a diagram for explaining a setting flow of a print pattern according to Example 2. The print pattern setting unit 141, first, determines an image quality level (not shown). Next, the print pattern setting unit 141 determines whether or not the printing medium is an opaque medium on the basis of the information from the printer driver (S101). In the case of the opaque medium (Yes in S101), printing in the rear print mode is not enabled. Therefore, the front print mode is determined, and the print pattern setting unit 141 determines whether or not printing is to be performed in the white use mode (S102). In the case of the white use mode (Yes in S102), the print pattern setting unit 141 sets a print pattern to the print pattern 5 determined as the test pattern result of the front print and white use mode with reference to the print pattern table (data at the image quality level 2) of the FIG. 13 (S103), and thus ink droplets are ejected from both the color use nozzles and the white use nozzles. In the case of not the white use mode (No in S102), the print pattern setting unit 141 sets the print pattern to the print pattern 5 determined as the test pattern result of the front print and white use mode (S104), and thus the ink droplets are ejected from only the color use nozzles while ink droplets are not ejected from the white use nozzles. Moreover, a sensor may be provided in the printer 1 to determine the type of the print medium.

When it is initially determined that the printing medium is not the opaque medium (No in S101), the print pattern setting unit 141 determines a print mode to the white use mode so that the opposite side is not transparent, and determines whether or not printing is to be performed in the front print mode (S105). In the case of the front print mode (Yes in S105), the print pattern setting unit 141 sets a print pattern to the print pattern 5 determined as the test pattern result of the front print and white use mode (S107), and thus ink droplets are ejected from both the color use nozzles and white use nozzles. In the case of the rear print mode (No in S105), the print pattern setting unit 141 sets the print pattern to the print pattern 3 determined as the test pattern result of the rear print and white use mode (S106), and thus ink droplets are ejected from both the color use nozzles and white use nozzles.

Accordingly, the printer 1 can perform printing in a suitable print pattern in each print mode, thereby performing printing in the print pattern with good image quality and at high printing speed. In addition, since the print mode is determined in response to the type of the medium, the method of determining the print mode can be easily performed. In addition, since the white use mode is always selected in the case of the transparent medium, it is possible to prevent the opposite side of the color image from being transparent. Moreover, even in the case where the printer driver determines the print mode, the method of determining the print mode as in the flow of FIG. 15 may be performed.

However, the method is not limited to the flow of FIG. 15. For example, in the case of the opaque medium (Yes in S101), the opposite side is not transparent, so that the print pattern setting unit 141 may determine the color mode. In addition, in the case of the opaque medium (Yes in S101), it is determined whether or not the opaque medium is white. When the medium is white, the background image does not need to be printed, so that the print pattern setting unit 141 determines the color mode. When the medium is not white, since color developing property of the color image is enhanced as the background image is printed, the white use mode may be determined. In addition, in the case of the transparent medium other than the opaque medium (No in S101), the print pattern setting unit 141 may determine the rear print mode. Even in this case, the printer driver may be allowed to perform the same print mode determination method as the print pattern setting unit 141.

Modified Examples of Image

While the background image in which the tone of white color is adjusted using white ink and color ink is exemplified, the invention is not limited thereto. A background image printed only using white ink may be allowed. However, in this case, the background image with only the white ink color may be printed. Accordingly, a background image with a desired color cannot be printed, and a difference between the color of the background image and a base color of the medium is noticeable. Therefore, the background image with high quality cannot be printed. Hereinafter, a print example in the case where the background image is printed with only the white ink will be described.

Figure 16:
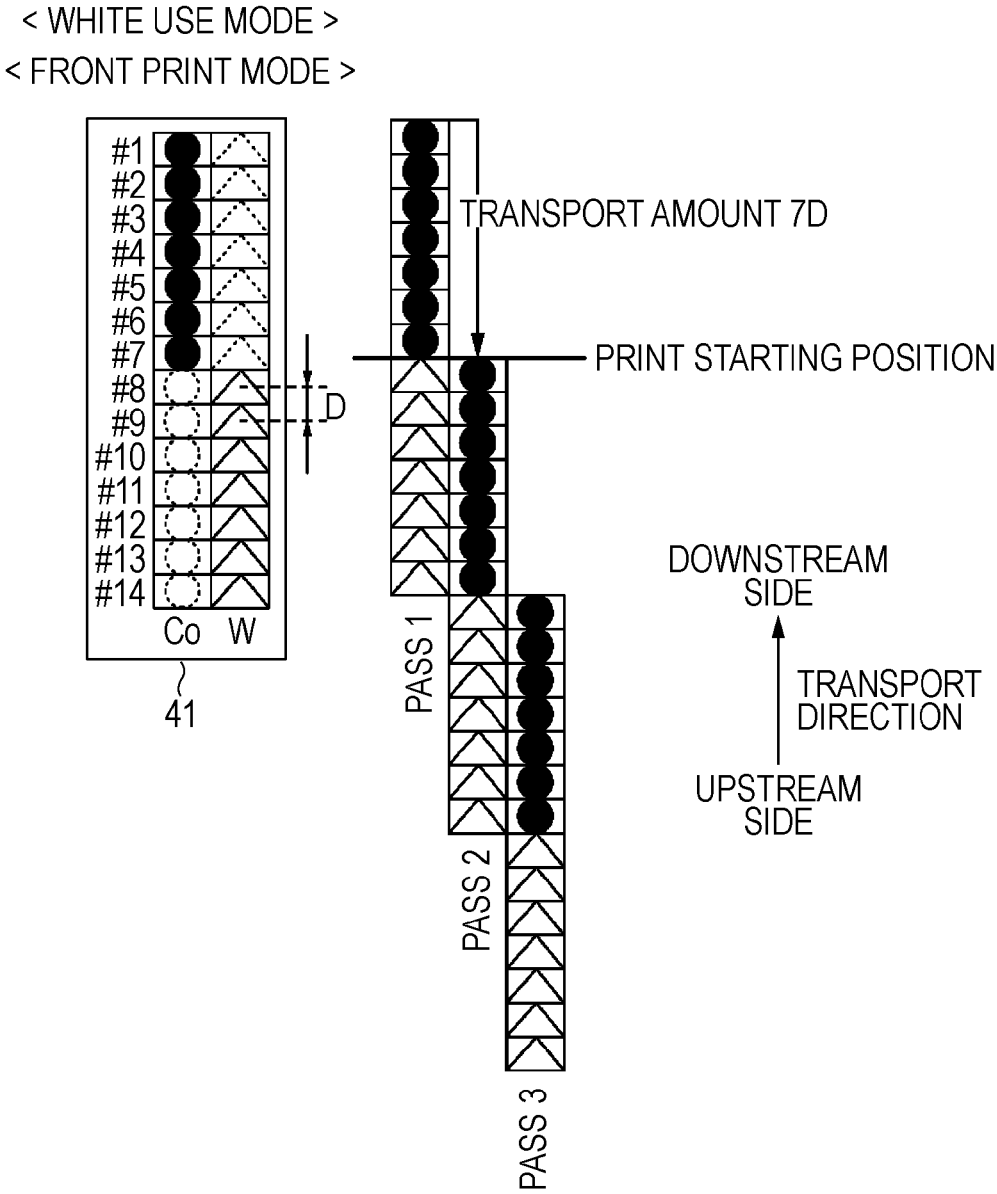
FIG. 16 is a diagram illustrating a printed example in the front print and white use mode.
Figure 17:
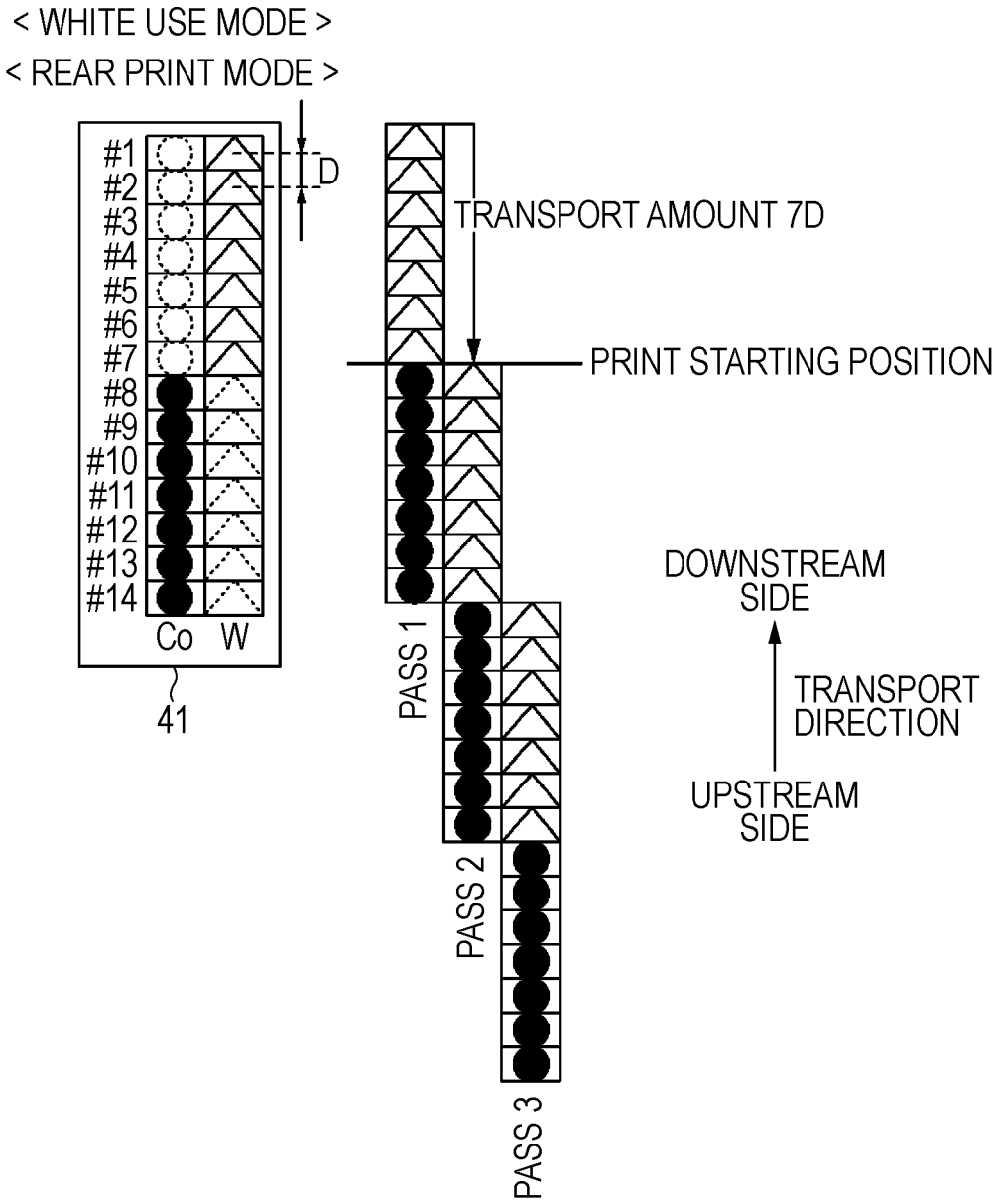
FIG. 17 is a diagram illustrating a printed example in the rear print and white use mode.

FIG. 16 is a diagram illustrating a printed example in the front print and white use mode. FIG. 17 is a diagram illustrating a printed example in the rear print and white use mode. In the figures, for the simplification of the description, the number of nozzles that belong to a single nozzle row is reduced to 14. In addition, the nozzle rows for ejecting four color inks (YMCK) are collectively referred to as the "color nozzle row Co (corresponding to the first nozzle row)". FIGS. 16 and 17 illustrate band printing. Band printing is a printing method in which band images formed in one pass are lined up in the transport direction and a raster line is not formed in another pass inside a raster line (a dot row along the movement direction) formed in any pass.

In the front print and white use mode of FIG. 16, a background image is printed on a predetermined area of a medium in advance, and a color image is printed thereon. Accordingly, half (#8Δ to #14Δ) of nozzles in the white nozzle row W (corresponding to a second nozzle row) on the upstream side of the transport direction serve as use nozzles for printing the background image, and half (#1• to #7•) of the nozzles in the color nozzle row Co on the downstream side of the transport direction serve as use nozzles for printing the color image. Moreover, in the front and white use mode, ink is not ejected from half (#1 to #7) of the nozzles in the white nozzle row W on the downstream side of the transport direction and from half (#8 to #14) of the nozzles in the color nozzle row Co on the upstream side of the transport direction. In addition, since FIG. 16 illustrates band printing, an amount of the medium transported once corresponds to a width in the transport direction of the image formed in one pass. In the white use mode, since two types of images are formed in one pass, the amount of the medium transported once corresponds to a width in the transport direction of the background image or the color image formed in one pass. Therefore, in FIG. 16, the amount of the medium transported once is a length "7D" of the half of the nozzle row (the total length of the seven nozzles).

That is, in the front print and white use mode, an operation of forming images using the use nozzles in the white nozzle row W on the upstream side of the transport direction and the use nozzles in the color nozzle row Co on the downstream side of the transport direction, and an operation of transporting the medium by only the transport amount 7D are repeatedly performed. As a result, the predetermined area of the medium is opposed to the use nozzles (#8 to #14) in the white nozzle row W on the upstream side of the transport direction, and the background image is printed on the predetermined area of the medium. Thereafter, as the medium is transported to the downstream side of the transport direction, the predetermined area of the medium is opposed to the use nozzles (#1 to #7) in the color nozzle row Co on the downstream side of the transport direction, and the color image is printed on the background image in the predetermined area of the medium.

On the contrary, in the rear print and white use mode, as illustrated in FIG. 17, half (#1Δ to #7Δ) of the nozzles in the white nozzle row W on the downstream side of the transport direction serve as use nozzles for printing the background image, and half (#8● to #14●) of the nozzles in the color nozzle row Co on the upstream side of the transport direction serve as use nozzles for printing the color image. In addition, the amount of the medium transported once is the length 7D of the half of the nozzle row. As a result, the predetermined area of the medium is first opposed to the use nozzles (#8 to #14) in the color nozzle row Co on the upstream side of the transport direction, and the color image is printed on the predetermined area of the medium. Thereafter, as the medium is transported to the downstream side of the transport direction, the predetermined area of the medium is opposed to the use nozzles (#1 to #7) in the white nozzle row W on the downstream side of the transport direction, and the background image is printed on the color image in the predetermined area of the medium.

In the above-described embodiments, the color image is printed with only the four color inks (YMCK); however, the invention is not limited thereto. For example, the color image may be printed using the white ink as well as the four color inks In this case, in the front print and white use mode described above and illustrated in FIG. 5, the color image is printed using the half (#1 to #7) of the nozzles in the color nozzle row Co and the white nozzle row W on the downstream side of the transport direction. On the other hand, in the rear print and white use mode described above and illustrated in FIG. 6, the color image is printed using the half (#8 to #14) of the nozzles in the color nozzle row Co and the white nozzle row W on the upstream side of the transport direction. As described above, the position in the transport direction of the nozzles in the color nozzle row Co for printing the color image and the position in the transport direction of the nozzles in the white nozzle row W for printing the color image are aligned. Then, to print the color image, the color ink and the white ink are ejected to the predetermined area of the medium in the same pass. As described above, as the color image is printed by adding the white ink to the color ink, an image which has high brightness and reproduces colors with high chroma can be printed.

Moreover, even when the color image in which the white ink is added to the color ink is printed, the same nozzles (color nozzles and white nozzles) may be used for printing the color image in the color mode and the white use mode. In addition, an optimal print pattern may be determined for one of the color mode and the white use mode to print the color image, and in the other mode, the color image may be printed in the determined print pattern.

Other Embodiments

In each of the embodiments described above, the main parts of a printing system having the ink jet printer has been described; however, the start of setting the print pattern or the like is also included. In addition, the embodiments are provided for easy understanding of the invention and are not intended to limit the invention. Modifications and improvements can be made without departing from the spirit and scope of the invention, and it is needless to say that equivalent matters are included in the invention. Particularly, the embodiments described later are also included in the invention.

Settings of Print Patterns

In the above-described embodiments, the color nozzles used in the white use mode may be the same as those used in the color mode, and the optimal print pattern determined in the white use mode is applied during printing in the color mode to simplify the manufacturing process of the printer 1; however, the invention is not limited thereto. For example, even when the printer 1 determines to perform printing in one type of print pattern (for example, the band printing in FIG. 5 or 6), the color nozzles used in the white use mode may be the same as those used in the color mode. If the half of the nozzles in the color nozzle row Co is used in the white use mode while the entire nozzles in the color nozzle row Co are used in the color mode, during band printing, the transport amount of the white use mode corresponds to the half of the length of the color nozzle row Co, and the transport amount of the color mode corresponds to the entire length of the color nozzle row Co. As described above, the amounts of the medium transported once are different, transport characteristics are also different (for example, transport errors occur in different ways). Therefore, in the manufacturing process of the printer 1, transport control (for example, a corrected transport amount) corresponding to the color mode and transport control corresponding to the white use mode need to be determined, resulting in complexity of the manufacturing process. Further, the transport control determined to correspond to the color mode and the transport control determined to correspond to the white use mode have to be stored in the memory 13 of the printer 1, resulting an increase in necessary memory capacity. Therefore, even in the printer with a fixed print pattern, the nozzles may be shared by the white use mode and the color mode.

In addition, the operation for selecting an optimal print pattern for each printer 1 from among a plurality of print patterns may not be performed, and a single print pattern may be set in advance. In addition, the print pattern of the white use mode and the print pattern of the color mode may be set to be different. Even in this case, as the nozzles for printing the color image are shared by the white use mode and the color mode, characteristics of the nozzles for printing the color image become constant, so that image quality of the color images is the same in both modes. For example, by excluding defect nozzles in the nozzles for printing the color image, quality of the color images in both modes can be enhanced. In addition, particularly, as the print patterns in both modes are shared, the image quality of the color image becomes the same in both modes.

Background Image

In the above-described embodiments, the background image is printed with the white ink; however, the invention is not limited thereto, and the background image may be printed with color ink (for example, metallic ink) other than the white ink. In addition, the invention is not limited to the case in which the background image is printed with only the white ink, and the background image of which the tone of white color is adjusted by mixing the white ink with other color inks may be printed. In addition, the color image may be printed by adding white ink to the four color inks (YMCK). Even in this case, the nozzles for printing the color image in the color mode may be the same as the nozzles for printing the color image in the white use mode.

Printer

In the above-described embodiments, the printer which repeatedly performs the operation of forming an image on a single cut paper while moving the head 41 in the movement direction and the operation of transporting the single cut paper with respect to the head in the transport direction which intersects the movement direction is exemplified; however, the invention is not limited thereto. For example, a printer which repeatedly performs an operation of forming an image on a continuous paper transported in a print area while moving the head unit 40 including (a plurality of) the heads 41 in the medium transport direction and an operation of moving the head unit 40 in a paper width direction to form the image and thereafter transports a part of the medium on which the image is not printed yet to the print area may be used.

Fluid Ejecting Apparatus

In the above-described embodiments, the ink jet printer is exemplified as the fluid ejecting apparatus; however, the invention is not limited thereto. Any industrial apparatus other than the printer (printing apparatus) may be applied as long as it is a fluid ejecting apparatus. For example, a printing apparatus for attaching a pattern to a fabric, a color filter manufacturing apparatus, a display manufacturing apparatus for manufacturing an organic EL display or the like, a DNA chip manufacturing apparatus for manufacturing a DNA chip by applying a solution with dissolved DNA to a chip, and the like may be applied with the invention.

In addition, a fluid ejecting method for ejecting fluid from nozzles may be a piezo method of applying a voltage to a drive element (piezo element) to expand and contract a pressure chamber thereby ejecting fluid or a thermal method of generating bubbles in the nozzles using heat-generating elements and ejecting liquid due to the bubbles.

In addition, ink ejected from the head 41 may be an ultraviolet curable ink which cures when ultraviolet rays are irradiated.

What is claimed is:

1. A fluid ejecting apparatus comprising:

a first nozzle row comprising first nozzles for ejecting a first fluid, wherein the first nozzles are lined up in a predetermined direction;

a second nozzle row comprising second nozzles for ejecting a second fluid, wherein the second nozzles are lined up in the predetermined direction; and a control unit which repeatedly performs an ejecting operation of ejecting fluid from the nozzles while relatively moving relative positions of the first and second nozzle rows and a medium in a movement direction intersecting the predetermined direction and a moving operation of relatively moving the relative positions of the first and second nozzle rows and the medium in one direction of the predetermined direction, wherein the fluid ejecting apparatus is configured to form images on the medium in one of:

a first mode of forming a main image with the first fluid on the medium; and a second mode of forming the main image and a background image with the second fluid to be overlapped on the medium, wherein the control unit forms the main image using a certain nozzle group in the first nozzle row when the main image is formed in the first mode, and forms the main image using the same nozzle group as the certain nozzle group when the main image is formed in the second mode;

wherein the control unit forms an image on the medium in one of a first method of forming an image viewed from an image formation side and a second method of forming an image viewed from the reverse side to the image formation side on the medium, when the image is formed in the first method, in the second mode, the control unit forms the main image by a nozzle group of a part of the first nozzle row positioned on the one direction side of the predetermined direction and forms the background image by a nozzle group of a part of the second nozzle row positioned closer to the other direction side of the predetermined direction than the nozzle group used for forming the main image, and in the first mode, the control unit forms the main image using the same nozzle group as the nozzle group in the first nozzle row for forming the main image in the second mode and in the first method, and when the image is formed in the second method, in the second mode, the control unit forms the main image by the nozzle group of the part of the first nozzle row positioned on the other direction side of the predetermined direction and forms the background image by the nozzle group of the part of the second nozzle row positioned closer to the one direction side of the predetermined direction than the nozzle group for forming the main image, and in the first mode, the control unit forms the main image using the same nozzle group as the nozzle group in the first nozzle row for forming the main image in the second mode and in the second method.

2. The fluid ejecting apparatus according to claim 1, wherein a dot formation method of forming the main image in the first mode and in the first method is the same as a dot formation method of forming the main image in the second mode and in the first method, and a dot formation method of forming the main image in the first mode and in the second method is the same as a dot formation method of forming the main image in the second mode and in the second method.

3. The fluid ejecting apparatus according to claim 1, wherein the control unit forms an image on the medium in the first mode when the first method is selected, or forms an image on the medium in the first method when the first mode is selected.

4. The fluid ejecting apparatus according to claim 1, wherein the control unit forms an image on the medium in the first mode and in the first method when the medium is an opaque medium.

5. The fluid ejecting apparatus according to claim 1, wherein a dot formation method used when an image at a predetermined image quality level is formed on the medium in the first method and a dot formation method used when an image at the predetermined image quality level is formed on the medium in the second method are different from each other.

6. The fluid ejecting apparatus according to claim 1, wherein a dot formation method of forming the main image in the first mode is the same as a dot formation method of forming the main image in the second mode.

7. The fluid ejecting apparatus according to claim 1, wherein the background image is formed using the nozzles in the first nozzle row disposed at the same position in the predetermined direction as the nozzle group in the second nozzle row for forming the background image.

8. The fluid ejecting apparatus according to claim 1, wherein the fluid ejecting apparatus is configured to form images on the medium in both the first mode and the second mode, wherein the control unit selects either the first mode or the second mode for each image to be formed.

9. A fluid ejecting method of a fluid ejecting apparatus which repeatedly performs an ejecting operation of ejecting fluid from nozzles while relatively moving relative positions of a first nozzle row comprising first ones of the nozzles for ejecting first fluid, wherein the first ones of the nozzles are lined up in a predetermined direction; a second nozzle row comprising second ones of the nozzles for ejecting second fluid, wherein the second ones of the nozzles are lined up in the predetermined direction; and a medium in a movement direction intersecting the predetermined direction, and a moving operation of relatively moving the relative positions of the first and second nozzle rows and the medium in one direction of the predetermined direction, wherein the fluid ejecting apparatus is configured to form images on the medium in one of: a first mode of forming a main image with the first fluid on the medium; and a second mode of forming the main image and a background image with the second fluid to be overlapped on the medium, the fluid ejecting method comprising, for each image to be formed:

forming the image on the medium in the first or second mode; wherein forming the image comprises:

forming the main image using a certain nozzle group in the first nozzle row when the main image is formed in the first mode; and forming the main image using the same nozzle group as the certain nozzle group when the main image is formed in the second mode;

wherein forming the image further comprises forming the image on the medium in one of a first method of forming an image viewed from an image formation side and a second method of forming an image viewed from the reverse side to the image formation side on the medium, when the image is formed in the first method, in the second mode, forming the image comprises forming the main image by a nozzle group of a part of the first nozzle row positioned on the one direction side of the predetermined direction and forming the background image by a nozzle group of a part of the second nozzle row positioned closer to the other direction side of the predetermined direction than the nozzle group used for forming the main image, and in the first mode, forming the image comprises forming the main image using the same nozzle group as the nozzle group in the first nozzle row for forming the main image in the second mode and in the first method, and when the image is formed in the second method, in the second mode, forming the image comprises forming the main image by the nozzle group of the part of the first nozzle row positioned on the other direction side of the predetermined direction and forms the background image by the nozzle group of the part of the second nozzle row positioned closer to the one direction side of the predetermined direction than the nozzle group for forming the main image, and in the first mode, forming the image comprises forming the main image using the same nozzle group as the nozzle group in the first nozzle row for forming the main image in the second mode and in the second method.

10. The method according to claim 9, wherein the fluid ejecting apparatus is configured to form images on the medium in both the first mode and the second mode, the method further comprising, for each image to be formed, selecting either the first mode or the second mode.

* * * * *